United States Patent [19]

Cushing et al.

[11] 4,010,502

[45] Mar. 8, 1977

[54] APPARATUS FOR EDGE PROCESSING WORK AND PARTICULARLY NON-CIRCULAR WORK

[75] Inventors: Richard D. Cushing, Newton; Alfred E. Beck, Jr., Exeter, both of N.H.

[73] Assignee: Circle Machine Co., Inc., Seabrook, N.H.

[22] Filed: May 15, 1975

[21] Appl. No.: 577,722

[52] U.S. Cl. ..... 12/86.7

[51] Int. Cl.[2] ..... A43D 7/00

[58] Field of Search ..... 12/86, 86.7, 87, 86.5; 112/121.12, 121.11

[56] References Cited

UNITED STATES PATENTS

| | | | |
|---|---|---|---|
| 2,359,395 | 10/1944 | Stacey | 12/86.7 |
| 3,134,998 | 6/1964 | Kunze et al. | 12/86.7 |
| 3,798,693 | 3/1974 | Bruggi | 12/87 |

*Primary Examiner*—Patrick D. Lawson

[57] ABSTRACT

Apparatus for processing the margins of work, both circular and non-circular, has a rotatable work holder provided with a clamping member to clamp work against a template. The processing is typically that of bringing the work to the size and shape established by the template and is effected by at least one tool. The disclosed apparatus has a pair of tools, both rotatable and each having a different function and the tools and their drive are carried by structure provided with means to reciprocate it between an inoperative position and a position in which the tools are in engagement with the periphery of the work. When the work is non-circular, the work holder and its drive so turn the work that its periphery advances into contact with the tools at a controlled rate. When work is to be processed without turning it two or more times, it is so turned that the zone first engaged by the tools is again engaged by them before the work holder is stopped in its predetermined starting position and, in the disclosed embodiment, the work holder is first moved to a predetermined minor extent in a reverse direction and is then rotated in a forward direction until the predetermined starting position is twice reached. The tool unit, its drive and that for the work holder are within a cabinet having a door behind which the tool unit is located. Control means provide that, first, the work is clamped in the work holder and, then, the door opened, the work holder rotated and the tool unit advanced into contact with the work. After the work has been processed, the sequence is reversed. A work locator is shown for use when it is desirable to ensure that the work is accurately positioned relative to the template before it is clamped thereto.

64 Claims, 22 Drawing Figures

APPARATUS FOR EDGE PROCESSING WORK AND PARTICULARLY NON-CIRCULAR WORK

BACKGROUND OF THE INVENTION

It is often a production requirement that blanks be processed to have a particular size and shape, an operation that presents difficulties that increase with the extent that the wanted shape departs from circular and from that of the blank and with the extent to which the thickness, construction, and material of the work to be processed varies. An example of such an operation, where the work is non-circular and one with which the present invention is particularly but not exclusively concerned, is the edge grinding of sole structure blanks.

Various apparatus have been made availiable for edge grinding shoe soles but a requirement exists for apparatus better adapted to produce accurately processed blanks either singly or in groups and which may differ widely as to materials, thickness, and construction, on a basis combining safety with a high production potential.

The Present Invention

The general objective of the present invention is to provide apparatus for quickly and accurately processing work, both circular and non-circular, by removing unwanted marginal material therefrom to impart to the finished work a desired size and shape with apparatus of the type having a rotatable work holder and a drive therefor, the work holder provided with means to clamp the work against a template. The periphery of the work is processed by at least one tool having at least one first portion operable to remove material from the work when in engagement therewith and a second portion engageable with the template when the unwanted material has been removed. The tool or tools are desirably but not necessarily rotatable and if rotatable are provided with means to rotate them and such means may be common to both tools.

Another objective of the invention is to provide a work holder and work holder drive that enables work in a wide range of different non-circular shapes to be processed as quickly and accurately as circular work, an objective attained with a work holder drive that provides a control of the peripheral speed of the work in spite of substantial radial variations, relative to the axis of rotation, of that portion of the periphery with which the tool or tools are in working contact. While the controlled rate is commonly a substantially constant rate, it may not be constant but may, for example, be one providing for deceleration in a zone where prolonged tool contact with the work is wanted. To that end, the work holder has a non-circular template that extablishes at least the shape of the finished work and a coaxial member that is the driven member of the work holder drive and that is of a non-circular shape that may be the same as that of the template but, for most purposes, needs to be but an approximation thereof. The templates and driven member are in corresponding positions and the drive includes means connected to the margin of the driven member. While the connection may be frictional, it is preferred that the non-circular driven member either have a marginal series of gear teeth with the driving means a gear in mesh therewith and resilient means maintaining the driving and driven member in mesh as the work holder turns or that the driving means may be an endless flexible member trained about the non-circular driven member with a rotatable drive member and idlers and maintained by resilient means in driving engagement therewith as the work holder turns. In any case, means are provided to permit relative movement between the work holder and the tool or tools, preferably with the work holder so supported for such movement that the axis of the template can follow the path dictated by the engagement of the turning work with the tool or tools and with the work holder rotatably mounted on a support pivotally connected to a linking member to swing relative thereto and with the linking member pivotally connected to the framework of the apparatus.

Another objective of the invention is to provide for the processing of the work, whether circular or non-circular by first and second rotatable tools, each having a function different than the other, and another objective is to have the two tools supported side-by-side by a holder pivotally connected to the support with the pivot axis of the holder between the axes of the tools. Another objective is to enable the two tools to have a common drive, the pivot axis of the holder then being between the axes of the two tools and in the same plane and the drive for the two tools includes a flexible element in trained engagement with driven members, each fixed on a corresponding end of the appropriate tool.

Another objective of the invention is to provide apparatus that may be safely operated with the motor rotating the work holder continuously operating as well as that of the tool drive when the tool or tools are rotatable, an objective attained with the tool supporting structure movable between an inoperative position remote from the work holder and an operative position in which the tool or tools are in contact with the clamped work and with the work holder drive provided with clutch means. Control means are provided to provide a cycle, after work has been placed on the template, first to clamp the work in place and then to move the tool or tools into the operative position thereof, operate the clutch means to effect the rotation of the work holder until the unwanted material has been removed and then reverse the sequence so that at the end of the cycle, the clutch means are disengaged with the work holder in a predetermined starting position, the tool or tools inoperatively positioned and the processed work unclamped.

Yet another objective of the invention is to have a shield that is reciprocable between a first position in which it is between the work holder and the inoperative position of the tool or tools and a second position in which it is out of the path of the tool or tools advancing for engagement with the periphery of the clamped work or returning from such engagement. In the disclosed embodiment of the invention, the shield is a cabinet door.

Another objective of the present invention is to provide that the work holder, at the end of each cycle, is in a predetermined, work-receiving, starting position, an objective attained with a drive including first and second parallel shafts with clutch controlled connections between them, one operative to effect forward rotation of the second shaft and the other to effect reverse rotation thereof. The second shaft is connected to a speed reducing unit. Controls provide for the engagement of the clutches of the connections and for their disengagement with their disengagement effected in predetermined positions of the work holder with the gear train of the speed reducer effectively preventing any unwanted turning of the work holder, once an engaged clutch is disengaged.

Another objective of the invention is to provide that, without turning the work through two complete revolutions, the tool or tools process its entire periphery to the desired extent, an objective attained with the work holder drive operable to effect work holder movement in a reverse direction to an extent respresenting a predetermined minor part of a complete revolution and then to effect the turning of the work holder forwardly until it reaches, for the second time, the predetermined starting position where it is then stopped, the preferred sequence being first with the drive in reverse and then with the work holder forwardly driven.

Another objective of the invention is to provide means operable to accurately position the work to be processed in a predetermined relation to the template when in its predetermined starting position, an objective attained by means of a locator movable between a loading position and a predetermined position relative to the work holder. The locator is adjustable to the size and shape of the work to be processed so that such work, when placed therein will be accurately located relative to the template when the locator is in its predetermined position relative to the work holder.

Another objective of the invention is to provide tools that may be adapted to meet the various requirements of the clamped work and the portion thereof that is to be processed, an objective attained with each tool including a shaft or spindle rotatably supported by a tool holder and connected to or connectable to a drive member. Each tool is provided with a material-removing portion and a portion that may be attached to its spindle or coaxially secured to the tool holder and dimensioned to engage the template when the unwanted material has been removed from the work. The material removing portion is fitted on the spindle between its threaded end and a shoulder and is locked thereto as by a nut threaded on that end and it may be a cutter or abrasive coated sleeve and it may consist of sections and these may be separated by a spacer that may be axially extendable.

Another objective of the invention is to provide for the control of the operation of the apparatus by fluid pressure, an objective attained by providing a piston-cylinder unit for each element of the apparatus that is movable into and held in one position during the operation of the apparatus and returned to another position at the end of each cycle and with control valves of the type set by a control system effective to cause the units to carry out their functions in the wanted order. First and second controls are provided, the first, when operated, effecting the operation of the work-clamping means and the second, when it and the first control are operative, setting the control valves into a position in which an operating cycle is initiated. The control system is operative to reset the control valves to end the cycle when the work is processed and the work holder is in its predetermined starting position.

The work holder drive, when the work is to processed without turning the work holder through at least two revolutions, has a clutch, to effect forward rotation of the work holder drive and a clutch to effect reverse rotation thereof, the clutches desirably, but not necessarily of a fluid pressure operated type. The operating pressure is delivered to the clutches and relieved therefrom so that one, desirably but not necessarily, the reverse clutch is engaged when the operating cycle is initiated. Means operable on predetermined rotation of the work holder, a minor movement in the case of reverse rotation, effects the relief of pressure from the engaged clutch and the delivery of operating pressure to the other clutch to effect its engagement, the forward clutch in the preferred sequence. Means operable on predetermined forward rotation of the work holder are effective to stop it in its predetermined starting position but are controlled by means also operated by work holder rotation that render the stopping means inoperative until the template has once passed through its starting position.

A particular objective of the invention is to use air both to effect the operation of the fluid pressure operated units and also in the control system to control the setting of the control valves. When the work holder is to be rotated first in one direction and then the other to an extent such that the tool or tools are in contact with the work while the work holder turns through more than 360° but always with a predetermined starting position, there are first, second and third valves in control of the drive, the valves of the type set in either one of two positions and the first and second controls are normally closed valves. The first and third valves are set in their second position when the second normally closed valve is opened to start a cycle and the first drive control valve then delivers operating fluid pressure to one clutch, preferably but not necessarily, that effecting reverse rotation of the work holder. A normally closed valve, operable on predetermined reverse movement of the work holder resets the first drive control valve in its first position then relieving the reverse clutch of its operating pressure so that it becomes disengaged, and also sets the second drive control valve in its second position with fluid under pressure now delivered through the first and second drive control valves to the other clutch, the clutch effecting forward rotation of the work holder in the preferred arrangement.

In the second position of the third drive control valve, a conduit in service in ending a cycle, is disconnected from the source and it includes a normally closed valve and, desirably a branch also having a normally closed valve, both operated when the work holder is in a predetermined starting position. The conduit is so connected to the second drive control valve that it is reset in its first position thus to effect the relief of pressure effecting clutch engagement effecting forward rotation of the work holder thereby to halt the work and its branch is operable to effect the return of the air-operated piston-cylinder units to the other position thereof. As in the forward rotation of the work holder, it must be turned through more than 360°, a reset conduit in communication with the air source is provided with a normally closed valve and is connected to the third drive control valve to reset it in its first position thus to connect the cycle-ending conduit to the source. The last named normally closed valve is located to be actuated when the work holder has been turned forwardly to a greater extent than it had been moved in the opposite direction whereby the cycle-ending conduit is not in communication with the source of air under pressure when its normally closed valves are first actuated.

BRIEF DESCRIPTION OF THE DRAWINGS

In the accompanying drawings, preferred embodiments of the invention are illustrated

The Preferred Embodiments of the Invention

Figure 1:
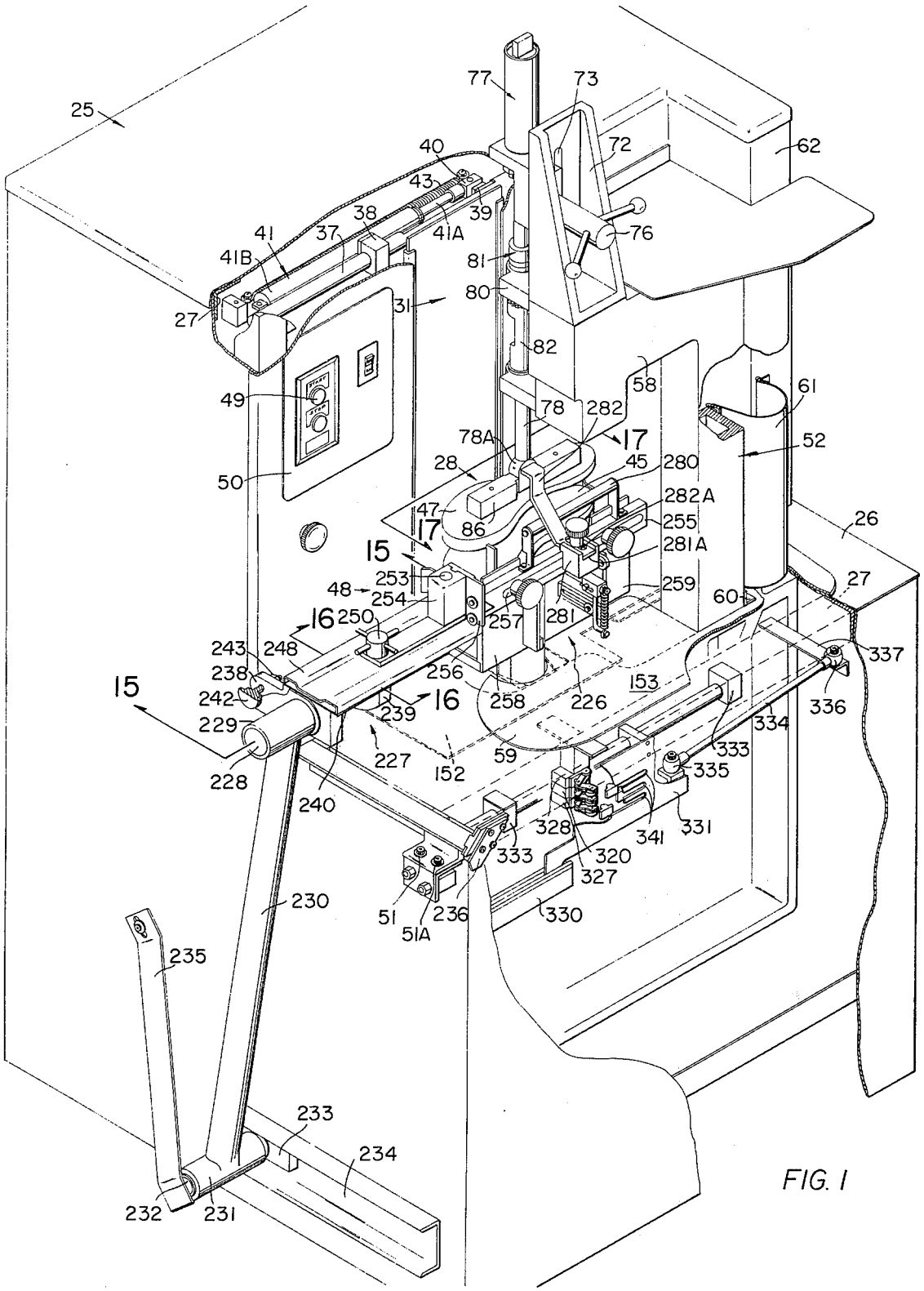
FIG. 1 is a front perspective view of the apparatus with the work locator positioned to support the work accurately with respect to the template of the rotatable work holder against which the work is to be clamped.
Figure 2:
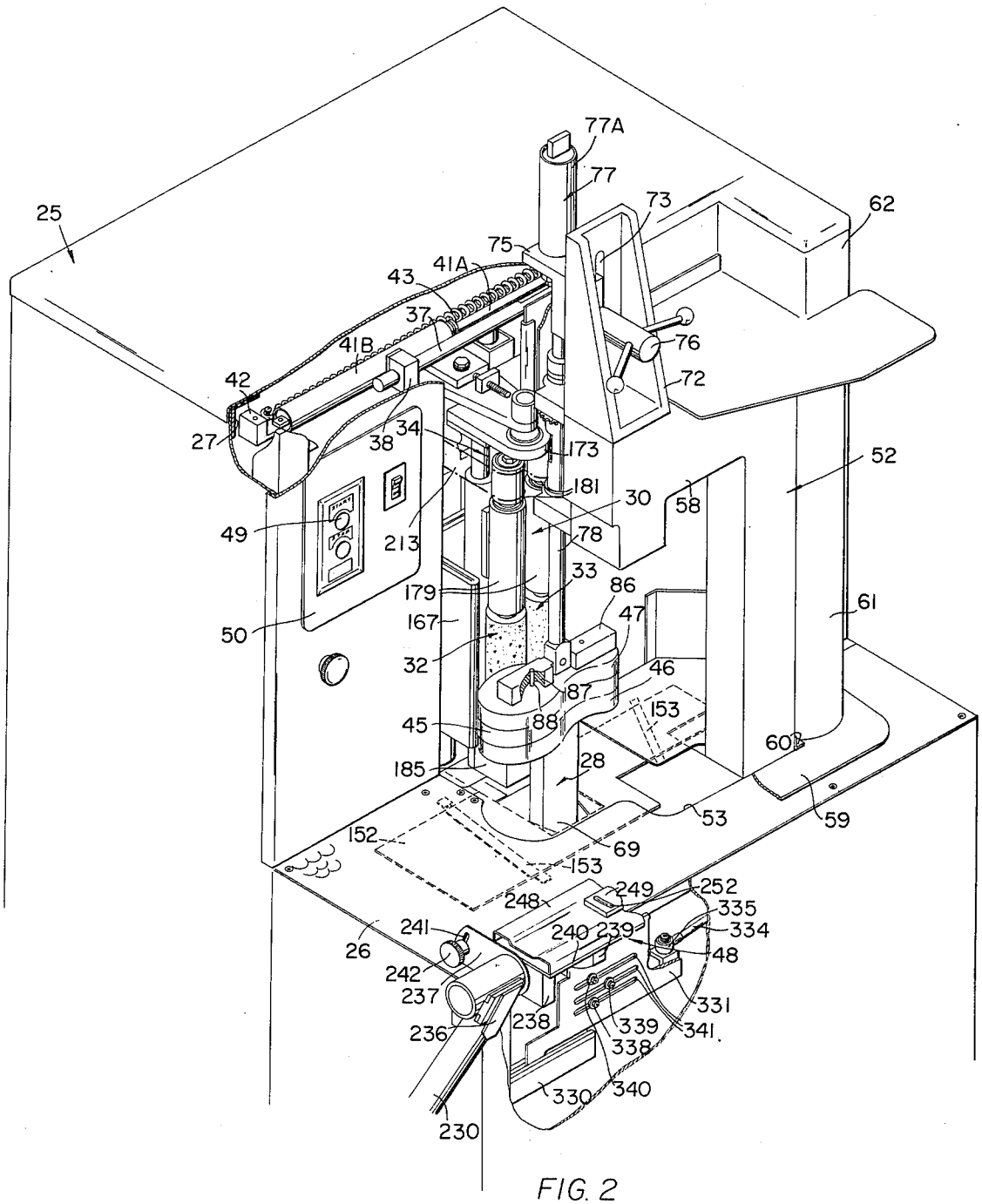
FIG. 2 is a like view of the apparatus but with the locator withdrawn into its work-receiving position, the work clamped, the door opened and the tool unit advanced therethrough into contact with the periphery of the work.

Reference is first made to FIGS. 1 and 2 in which there is shown a cabinet 25 having a shelf 26 extending from end-to-end of its front. The framework of the cabinet is indicated at 27 in certain of the drawings where it is necessary to show its use in supporting certain parts of the apparatus.

At this point, it is desirable to introduce the principal parts of the apparatus and their roles in its operation.

A rotatable work holder, generally indicated at 28, is located centrally of the shelf 26 and includes means operable to clamp the work in place while its margins are being processed. The work holder drive is generally indicated at 29, see FIG. 4. In the illustrated embodiment, a tool unit, generally indicated at 30, see FIGS. 2 and 9, and normally contained within the cabinet 25 rearwardly of the door or shield 31, includes a pair of rotatable tools 32 and 33, the tool 32 for rough-processing the periphery of the work and the tool 33 for finishing it and the tool drive is generally indicated at 34, see FIG. 9, and the support for the tools and their drive is generally indicated at 35. The support 35 is moved into and out of position in which the tools are in engagement with the work by a piston-cylinder unit generally indicated at 36, and its cylinder 36A is pivotally connected to side framework 27 under the shelf 26.

Figure 3:
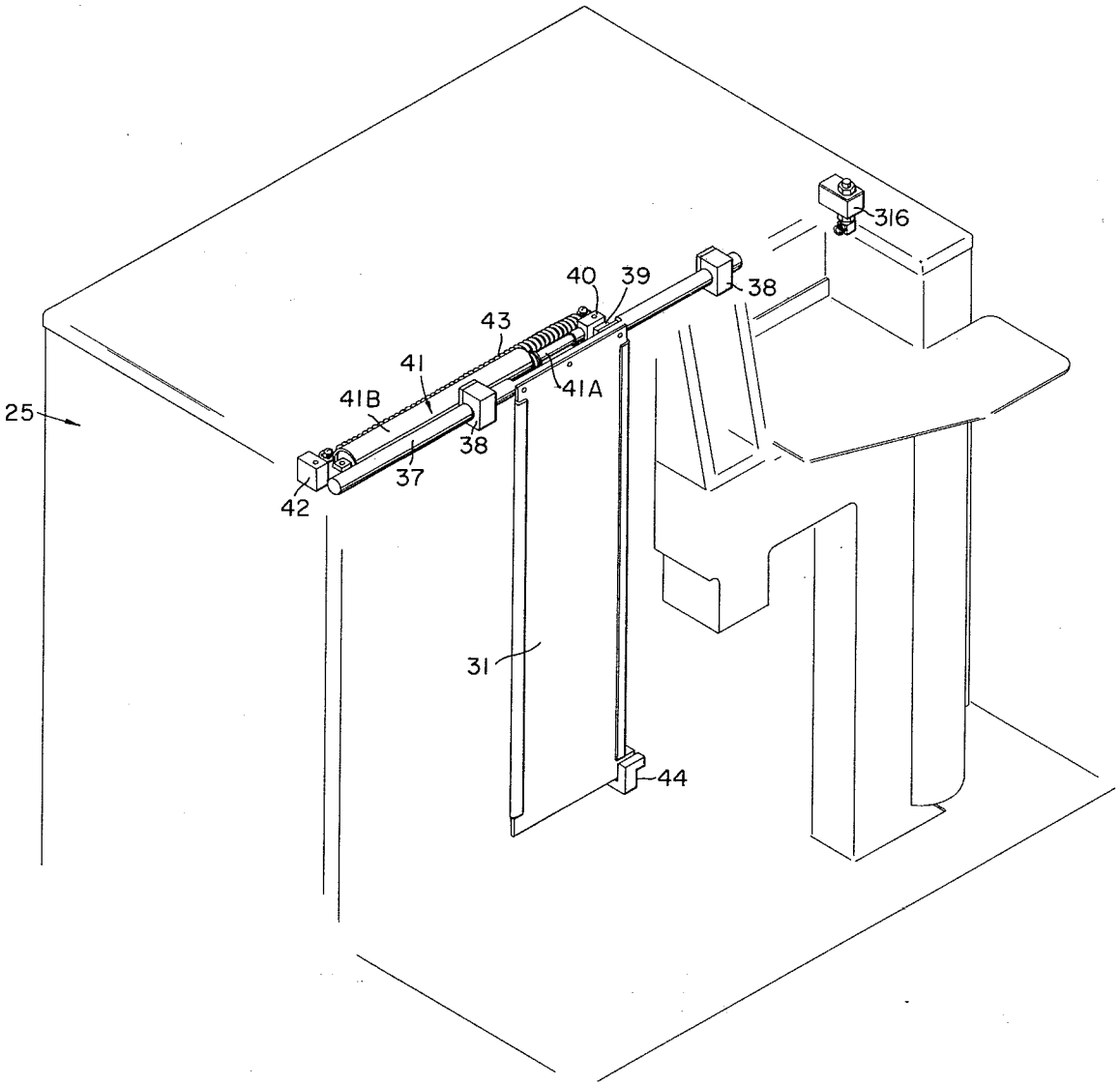
FIG. 3 is a fragmentary view showing the door and the means by which it is opened or closed.

The door 31, see FIGS. 1, 2, and 3, is attached to the central part of a rod 37 slidable in spaced supports 38 secured to front framework 27 extending transversely of the top of the cabinet. A bracket 39, also secured to the central part of the rod 37, is pivotally connected as at 40 to the stem 41A of a piston-cylinder unit generally indicated at 41 and whose cylinder 41B is pivotally connected to a mount 42 secured to the framework 27. One end of a spring 43 is anchored by the mount 42 and its other end is connected to the bracket 39 whereby the spring 43 is operable to pull the door 31 into its closed position once the pressure in the cylinder 41B is relieved. The control of the operation of the unit 41 will subsequently be detailed. A guide block 44 is supported by the framework 27 at the rear of the shelf 26 and slidably receives and confines the bottom of the door 31 as it is moved between its open and closed positions.

Figure 4:
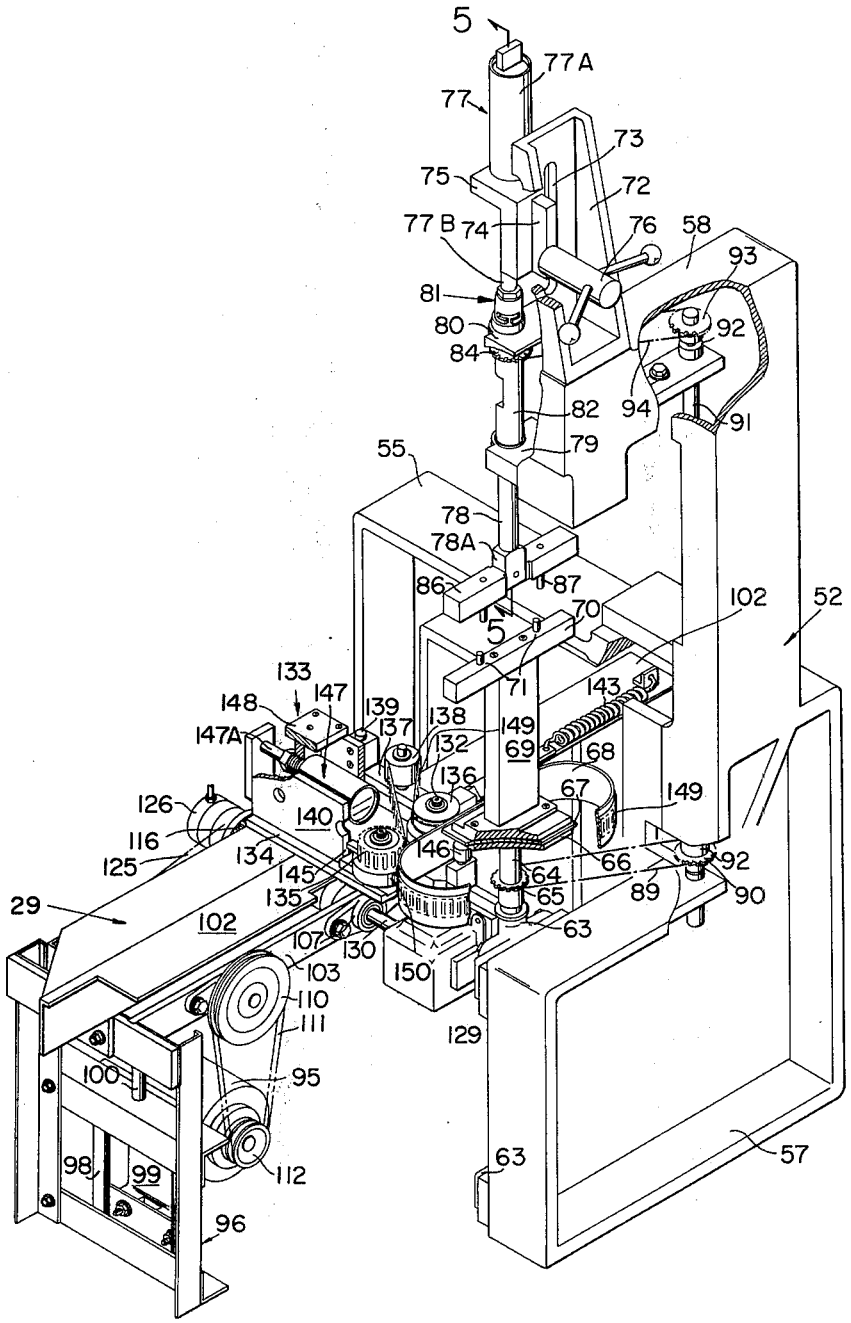
FIG. 4 is a perspective view of the work holder, its support, and the drive by which the work holder is rotated.

The work, in the embodiment of the invention illustrated by the drawing is typically sole structures and while in some cases the work may consist of plural pieces, it is herein discussed for the most part, as a single piece and it may be a sole, heel, or a sole and heel combination. Typically, but not necessarily, the entire periphery of the work is processed by at least one of the tools. In the drawings, such work is generally indicated at 45. One of the features of the work holder drive 29 is that it enables the peripheral speed of the work to be controlled, usually to provide a substantially constant surface speed in the case of non-circular work for all peripheral portions thereof but sometimes to provide a slower speed for a portion requiring longer exposure to either one or both tools. As the work rotates, its periphery is first engaged by the tool 32 and then by the tool 33. Another feature of that drive and one later more fully explained is that it moves the holder 28 in first one direction from a predetermined starting position and then in the other direction to ensure a continuous smooth finish by moving the work holder in one direction a predetermined relatively short distance and in the other direction enough more than 360° to return the work holder to its starting position where it is stopped. The work holder 28 is shown as including both lower and upper clamping members 46 and 47 between which the work 45 is clamped. One member, the member 46 is a template limiting the attack of the rotating tools 27 and 28. The other member 47 is desirably but not necessarily of the same size and shape and it may be and often is of a somewhat smaller size. The predetermined starting position of the work holder 28 is shown in FIGS. 1, 2, and 4 with the long axis of the template 46 parallel to the front edge of the shelf 26.

It will be appreciated that it is often necessary for production purposes, to provide means enabling the work 45 to be quickly and accurately positioned relative to the work holder template 46 and for that reason, a locator, generally indicated at 48, is provided. The locator 48 is movable between a work-receiving position adjacent the outer edge of the shelf 26 and a position in which the work 45 supported thereby is accurately positioned relative to the template 46 to be clamped thereto.

In practice, once the locator 48 is adjusted for work of a particular size and shape, the operator can easily place the work therein and bring it into a position to be clamped in the work holder. He then pushes the "start" button 49, in practice, a pushbutton valve, located on the control panel 50 and the work 45 becomes clamped against the template 48 by the clamping member 47 by means subsequently described.

The operation of second pushbutton valves 51 and 51A now starts a complete working cycle and as the disclosed embodiment of the invention utilizes the locator 48, the valves 41 and 51A are located, see FIG. 1, to be actuated when the locator 48 is in its work receiving position. In the case of an apparatus not having a locator, the valves 51 and 51A are located for manual operation. With the valves 49, 51, and the 51A momentarily opened, the unit 41 is operated to slide the door 31 into its open position and the unit 36 is operated to advance the tool unit 36 into a position in which the tools 32 and 33 engage the periphery of the clamped work 45, and the work holder 28 is simultaneously driven in the manner previously outlined. When the work holder 28 is stopped in its predetermined starting position, the tool unit 30 is retracted, the door 31 closed, and the finished work unclamped for removal by the operator.

The Work Holder

The work holder 28, see FIGS. 1, 2, 4, 5, and 7, includes a chambered upright support, generally indicated at 52 extending upwardly through a shelf opening 53 and having pivotal connections 54 below the shelf 26 with a rectangular mounting link 55 having pivotal connections 56 with side framework 27. The lower and upper ends of the support 52 include vertically aligned, horizontal, chambered arms 57 and 58, respectively, the arm 57 below the shelf and the arm 58 a substantial distance above it. The opening 53 is of substantial size since, as will subsequently be more fully explained, the turning of the work holder 28 is attended by movement of the support 52 through a path dictated by the template 46. The opening is shielded and the means for so doing includes a plate 59 connected to the support 52 preferably by a hinge 60. A flexible shield 61 is attached to the support 52 above the shelf 26 and to the side wall 62 of the cabinet 25.

Figure 7:
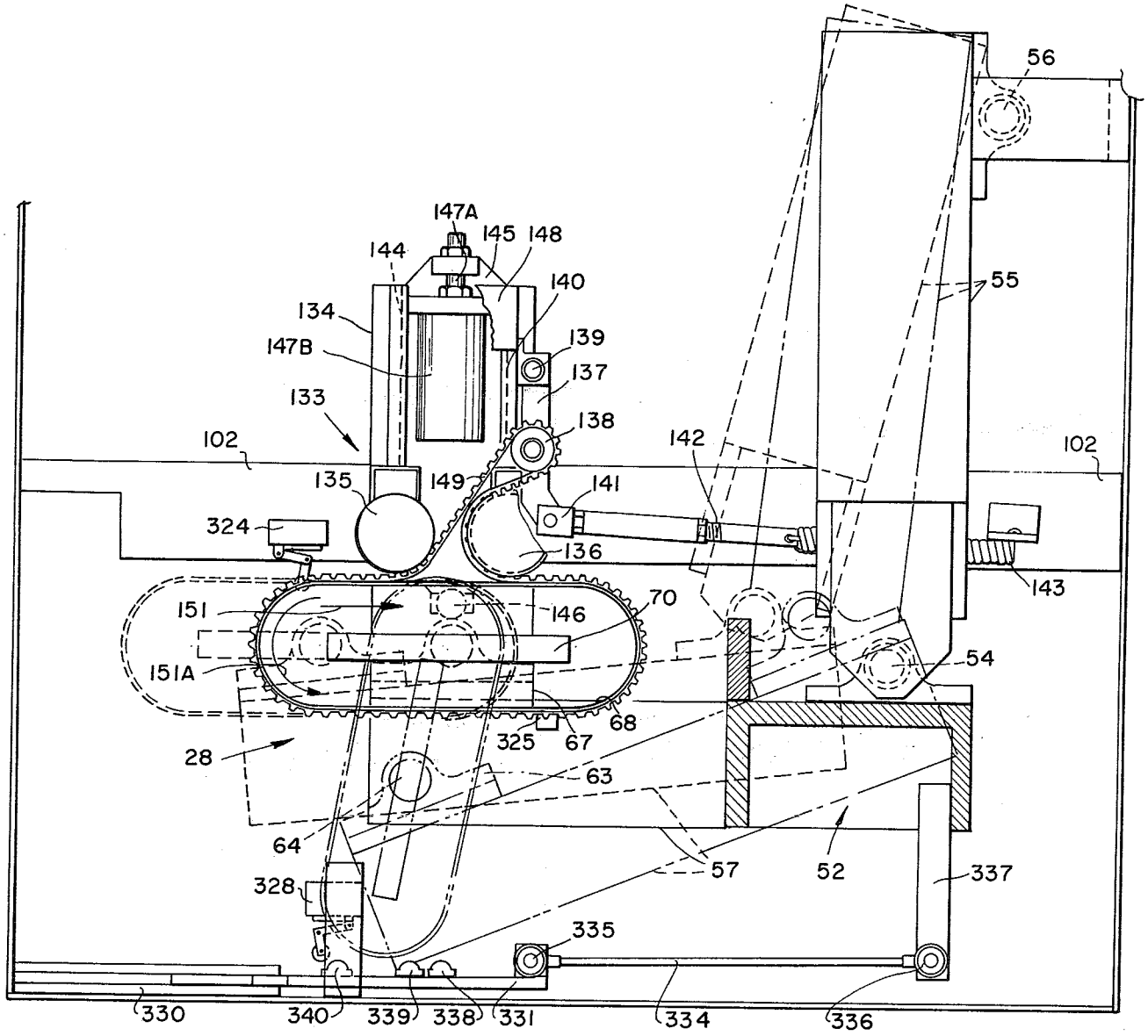
FIG. 7 is a horizontal section through the front part of the apparatus below the level of the shelf showing the driven member of the work holder, part of the drive therefor, and the work holder supporting structure.

The arm 57 has, see FIGS. 4 and 7, vertically spaced and aligned bearing mounts 63 adjacent its outer end rotatably supporting a vertical shaft 64 having a sprocket 65 and, at its upper end, a head plate 66 to which is detachably attached the centered support 67 of a wall member 68 that is either of or approximately the shape of the template 46. While the template 46 shown in the drawings establishes the shape of the processed work 45, a shoe sole, the member 68 is shown as substantially ovate with its shape determined by the wanted control of the peripheral speed of the work 45. A mount 69, omitted in FIG. 7, detachably attached to the member 67, has a transverse holder 70 provided with upwardly disposed pins 71 disposed to enter snap-fastener sockets in the undersurface of the template 46. The member 68 and the template 46 have a common axis of rotation. As the wall member 68 is the part connected to the work holder drive, it is herein referred to as the driven member.

Figure 5:
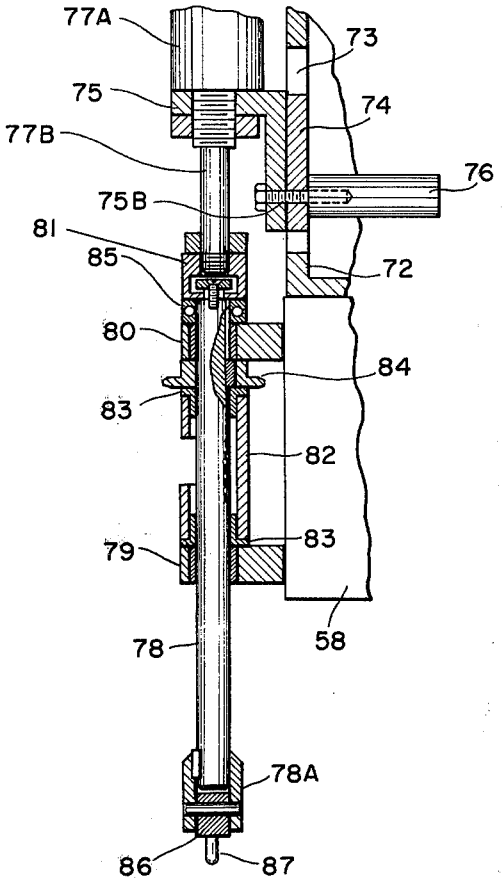
FIG. 5 is a section taken approximately along the indicated line 5—5 of FIG. 4.

The arm 58 has a mount 72, see FIGS. 4 and 5, fixed on the free end thereof and the mount 72 has a vertical slot 73 slidably receiving the rib 74 of a support 75 having a bolt 75B extending through the slot 73 with a lock 76 threaded thereon enabling the mount 72 to be moved upwardly or downwardly as may be required by the thickness of the work 45 and then secured in its adjusted position.

The cylinder 77A of a double-acting fluid pressure operated piston-cylinder unit, generally indicated at 77 is clamped to the support 75 with its stem 77B depending vertically. A shaft 78, slidably and rotatably confined in vertically spaced bearing blocks 79 and 80, secured to the rear face of the arm 58 at its outer end, is axially aligned with the shaft 64 and a connector, generally indicated at 81, between the shaft 78 and the stem 77B, permits the shaft 78 to rotate relative to the stem 77B but compels it to move axially therewith in whichever direction the stem 77B is caused to be moved. The shaft 78 passes freely through a sleeve 82 having end bearings 83, the lower resting on the bearing block 79. A sprocket 84 slidably splined to the shaft 78 is confined between the upper bearing 83 and the upper bearing block 80. The connector 81 includes a ball bearing assembly 85 engageable with the upper surface of the bearing block 80 when the stem 77B has been extended to its maximum extent. The shaft 78 has a connector 78A fixed on its lower end and pivotally supporting a transverse holder 86 which has downwardly disposed pins 87 entrant of snap-fastener sockets 88 in the upper surface of the clamping member 47.

The sprocket 65 on the shaft 64 is connected by a chain 89 to a sprocket 90 within the chambered support 52 and fast on the lower end of a shaft 91 extending vertically through the support 52 and supported therein by vertically spaced rotatable bearings 92. A sprocket 93, fast on the upper end of the shaft 91 and supported by a thrust bearing 92, and the sprockets 84 are connected by a chain 94 thereby causing the shafts 64 and 78 to rotate together.

The Drive For the Work Holder

Figure 6:
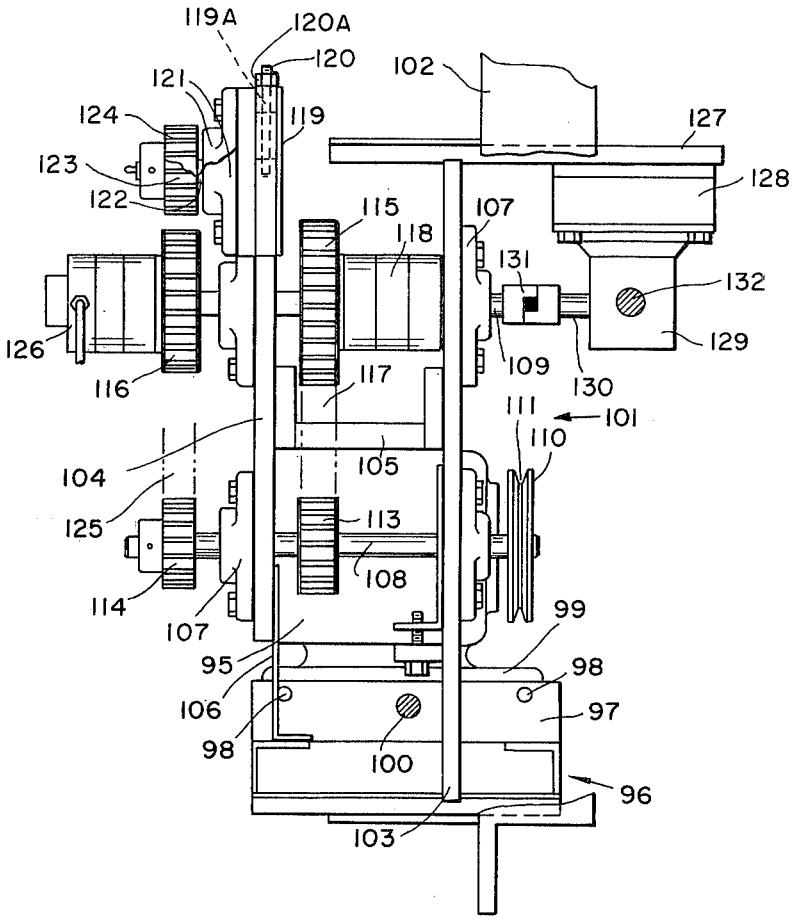
FIG. 6 is a plan view of that part of the drive that is controlled by the clutches to provide forward or reverse rotation of the work holder.

The drive 29 for the work holder 28, see FIGS. 4, 6, and 7, includes an electric motor 95. Framework 96 secured to one side of the framework 27 is provided with supporting structure 97 having vertical rods 98 slidably supporting the base 99 of the motor 95. An adjusting screw 100, rotatably connected to the base 99, has a threaded connection with the supporting structure 97 and is exposed in a position that is readily accessible should the vertical position of the motor need to be adjusted.

Framework, generally indicated at 101, see FIG. 6, includes an upper support 102 extending from side-to-side of the cabinet 25 and parallel bars 103 and 104 interconnected intermediate their ends by a cross support 105 and with the bar 104 also connected to the supporting structure 97 by a brace 106.

The bars 103 and 104 are provided with bearing units 107 rotatably supporting parallel shafts 108 and 109. The shaft 108 has on its inner end a pulley 110 preferably of the Reeves type in order to permit ratio changes to be easily effected, and a belt 111 is trained about it and the pulley 112 fast on the drive shaft of the motor 95. The shaft 108 is also provided with pulleys 113 and 114, both shown as of the gear type, the pulley 113 between the bars 103 and 104 and the pulley 114 on its outer end.

The shaft 109 has pulleys 115 and 116 both shown as of the gear type and free to rotate on the shaft 109 and the pulleys 113 and 115 have a belt 117 trained about them, the belt 117 of the type having transverse ribs ensuring its positive engagement with the pulleys. A clutch 118 is provided to connect the pulley 115 to the shaft 109 and it is of a type whose engagement is effected only while air under pressure is delivered thereto.

A holder 119 is slidably supported on the free end of the bar 104 and is provided with a shoulder 119A extending across but spaced from the proximate end thereof. An adjusting screw 120 is threaded through the shoulder 119A and into the end of the bar 104, enabling the position of the holder 119 to be adjusted lengthwise of the bar 104 and locked in place by the nut 120A. The holder 119 has vertically spaced and aligned bearing units 121 in support of stub shafts 122, the upper one having a pulley 123 fixed thereon and the lower one having a pulley 124 fixed on it, each pulley also of the gear type. The bearing units 121 are located so that the pulley 116 is close to them but between them and the pulley 114 with the axis of the pulley 123 above and the axis of the pulley 124 below the axis of the pulley 116 distances such that with a belt 125 of the same type as the belt 117 trained about the pulley 114 and the pulleys 123 and 124, its upper and lower courses are spaced from the pulley 116 and with the belt 125 of a length to provide a loop between the pulleys 123 trained about the pulley 116. With the belt 125 so trained that its engagement with the pulley 116 is positive, the engagement of its other face with the other pulleys is maintained positive since the adjustment of its holder 119 enables the belt 125 to be suitably tensioned against slippage. The pulley 116 is then driven in a direction opposite to that of the pulley 115 and it can be coupled to the shaft 109 by a clutch 126 of the same type as the clutch 118.

The frame 101 also includes a supporting bar 127 provided with a mount 128 for a gear box 129 having its input shaft 130 connected to the shaft 109 by a coupler 131. The gear box 129 has a vertical output shaft 132.

From the foregoing, it will be apparent that the shaft 132 is driven in one direction or the other, depending on which of the clutches 118, 125 is engaged. The clutch 118 controls forward rotation of the shaft 131 and the clutch 125 controls the referse rotation thereof. It will be noted that the diameters of the various pulleys are such that the rate of rotation of the shaft 132 forwardly is slower than its rate in the opposite direction.

A drive unit, connecting the shaft 132 to the driven member 68 is generally indicated at 133 and has its base 134 fixed on a framework support 102, see also FIG. 7. Gear-type pulleys 135 and 136 are rotatably attached to the forward end of the base 134. The pulley 135 is an idler while the pulley 136 is fast on the shaft 132. An arm 137 provided with an idler 138 is pivotally connected as at 138 to one of the side walls 140 of the unit 133 and it is also pivotally connected to a clevis 141 provided with an adjustable connector 142 including a spring 143 which is connected to the support 102 so that it is operative to yieldably urge the pulley 138 away from the base 134.

The side walls 140 of the unit 133 have channels 144 supporting a slide 145 having a guide roller 146 mounted on its outer end with the roller axis vertical and between the axes of the pulleys 135 and 136. The inner end of the slide 145 is connected to the stem 147A of a fluid pressure operated, piston-cylinder unit, generally indicated at 147, by which the slide 145 is yieldably held retracted until the fluid pressure in the unit 147 is relieved. The cylinder 147B of the unit 147 is secured to a mount 148 interconnecting the side walls 140.

The driven member 68, the pulleys 135 and 136 and the idler 138 are all in the same horizontal plane and a belt 149 of the type having an outer series of teeth is trained about the driven member 68, the pulleys 135 and 136 and the idler 138 with its teeth meshing with those of the pulleys 135 and 136 and its inner smooth surface in contact with the periphery of the driven member 68 of the work holder 28. The pulleys have annular portions 150 that are in engagement with the driven member 68 and that serve to hold the belt 149 in place.

When the work holder 28 is assembled, the slide 145 is under the driven member 68 and the guide roller 146 is within the driven member 68 and when fluid under pressure is introduced into the cylinder 147B of the unit 147, the roller 146 is held in engagement with the inner wall surface as the drive member turns and yieldably urges the engaged portion thereof towards the pulleys 135 and 136.

When the apparatus is in use, the motor 95 remains in operation and in the processing of the work in the preferred manner, the clutch 126 is first engaged. With the work holder drive in service, the work holder 28 is moved a predetermined distance that is a minor part of one revolution. The clutch 126 is then disengaged and the clutch 118 engaged until the work holder has turned forwardly through enough more than 360° to bring it into its predetermined starting position, the clutch 118 then disengaged and the substantial gear reduction provided by the speed reducer 129 ensuring that the work holder then does not turn to any appreciable extent. The means by which the engagement and disengagement of the clutches are controlled will subsequently be detailed.

As the driven member 68 is substantially ovate and the pulleys 135 and 136 are located close thereto in order that the belt 149 will engage a maximum portion of its periphery, relative movement between the pulleys and the member 68 occurs. In practice, the movement of the work holder 28 is relative to the pulleys 135 and 136 with its axis, as will be apparent from FIG. 7, moving linearly except when the driven member 68 is turned end-for-end and the support 52 is moved in a similar fashion.

In practice and for reasons apparent from the description of the operation of the apparatus, the predetermined starting position is that shown in dotted lines in FIG. 7. The initial function of the work holder drive is first, accordingly, that of first moving the driven member 86 linearly in the direction of the arrow 151 to a predetermined extent, its full line position, and then in the direction of the arrow 151A until the member 68 has been twice turned end-for-end and moved linearly to an extent bringing the member back into its predetermined starting position. As will later be detailed in connection with the operation of the apparatus, the movement of the support 52 along the straight paths is used to actuate certain ones of the controls by which the previously outlined operating cycle is automatically effected.

During such movement of the support 52, it causes the plate 59 to slide across the shelf 26. The shelf opening 53 is also shielded by a plate 152 slidably supported under the rearward part of the shelf 26 by holders 153 for movement by the platen mount 69 as it turns.

Figure 8:
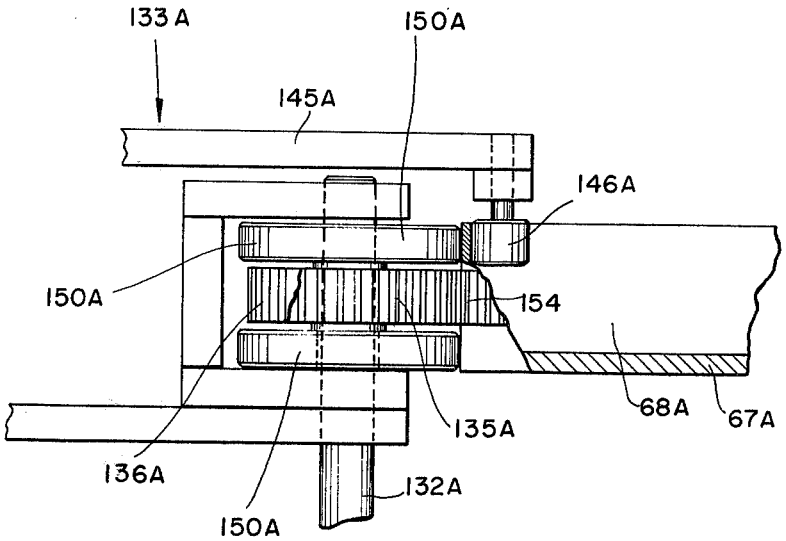
FIG. 8 is a fragmentary vertical section showing a driven member and part of the drive therefor in accordance with another embodiment of the invention.

Reference is here made to FIG. 8 in which there is shown a different driving connection between the speed reducer and the driven member of the work holder with corresponding parts distinguished by the suffix A applied to the appropriate reference numeral. While the unit 132A is substantially the same as the unit 132, gears 135A and 136A replace the pulleys 135 and 135, respectively. The driven member 68A of the work holder is of whatever non-circular shape that provides the wanted control of the peripheral speed of the work and has a series of gear teeth 154 extending exteriorly about it with which the gears 135A and 136A are in mesh. The gear teeth 154 are spaced from the upper and lower edges of the driven member 68A in order to accommodate the annular bearing portions 150A which engage the driven member 68A to prevent meshing gear teeth from bottoming. The slide 145A extends above the driven member 68A and the guide roller 146A extends downwardly within the driven member 68A and functions to maintain the gear teeth in mesh as the driven member is turned. In this embodiment, the driven member 68A extends upwardly relative to its support 67A.

While the use of gears ensures a positive drive, the belt and pulley drive previously detailed has proven satisfactory in use and is preferred although other types of belts and pulleys may be used.

The Tool Unit, Its Drive, and the Support Therefor

Figure 9:
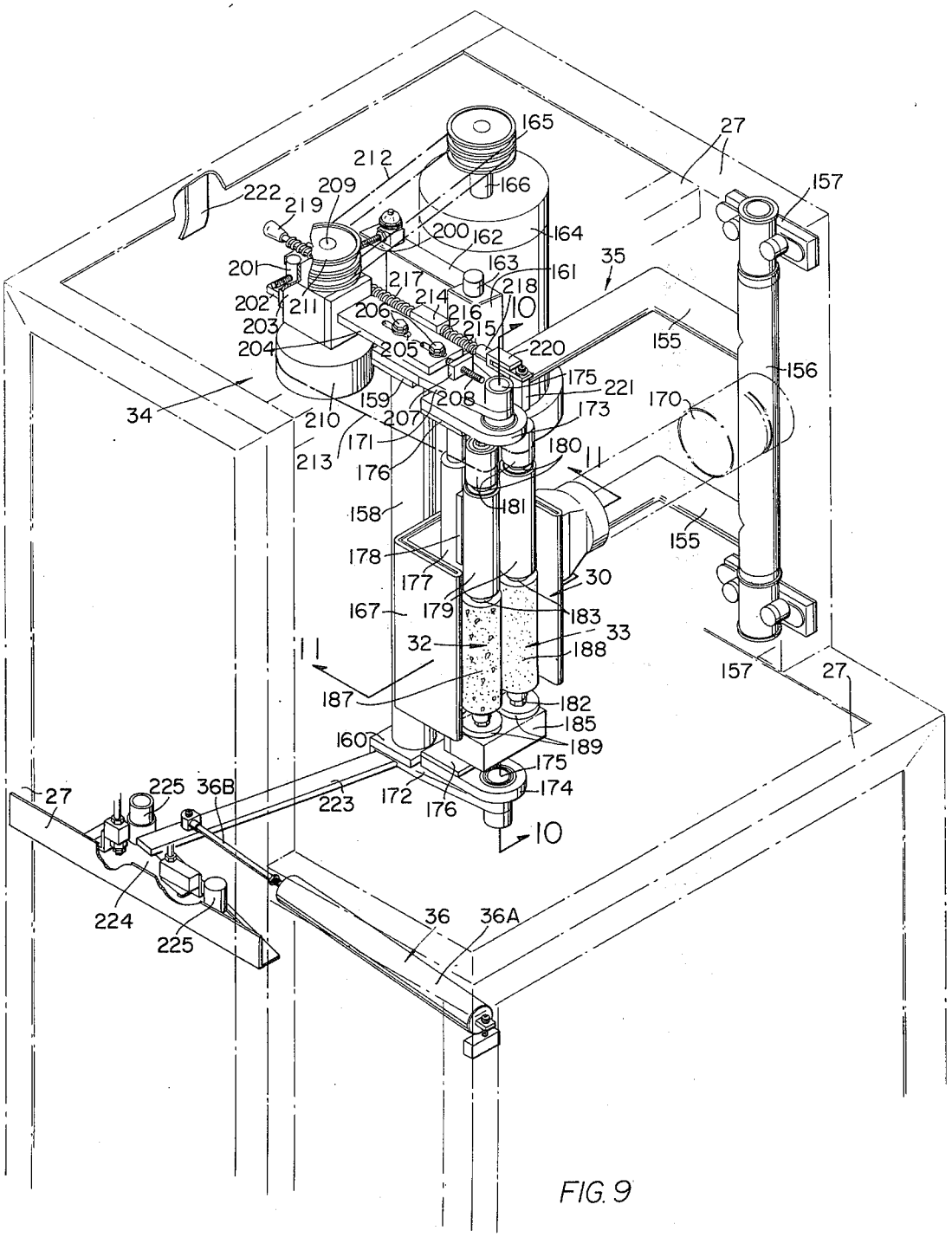
FIG. 9 is a perspective view showing the tools, the drive therefor, the support therefor, and the means by which the tool is moved into and out of engagement with the work.
Figure 10:
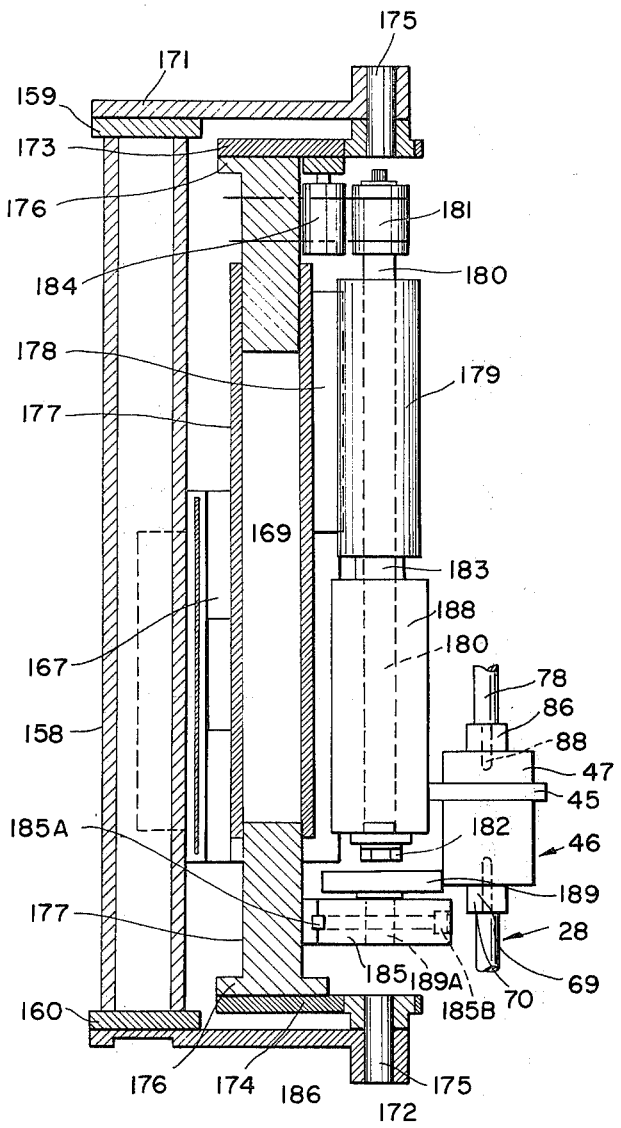
FIG. 10 is a section taken approximately along the indicated line 10—10 of FIG. 9.
Figure 11:
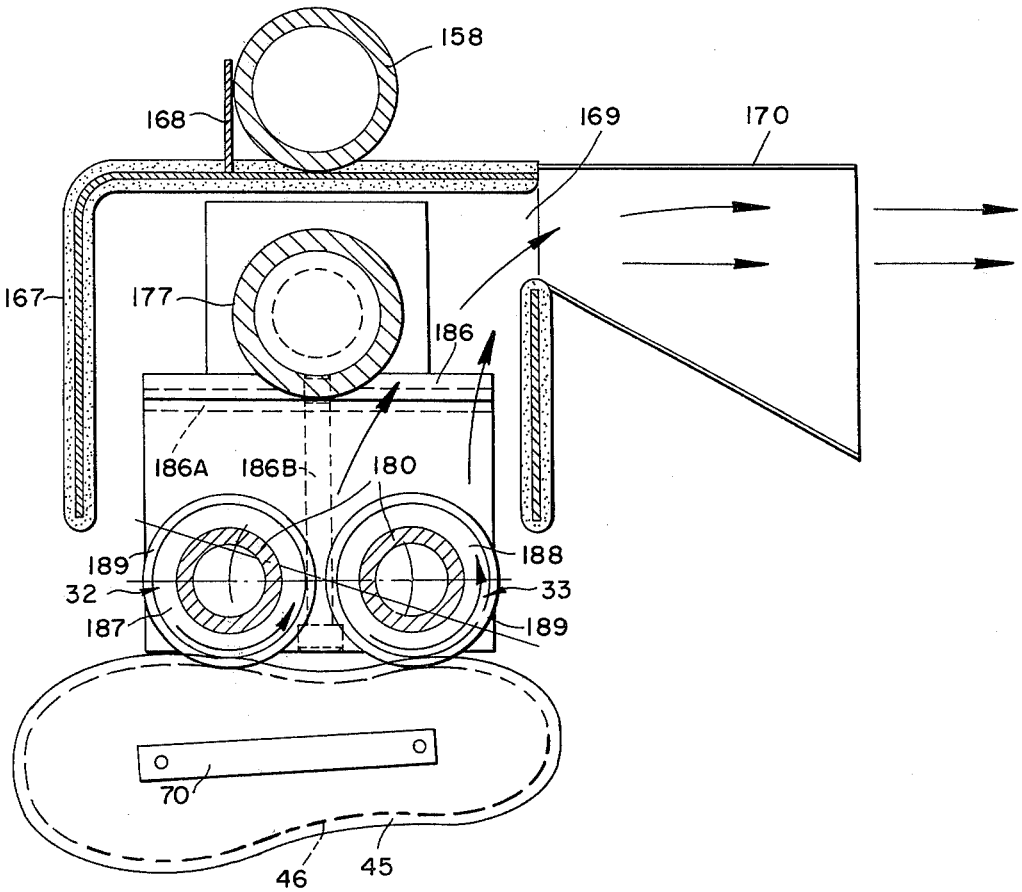
FIG. 11 is a section taken approximately along the indicated line 11—11 of FIG. 9.

The tool unit 30, its drive 34, and the support 35 therefor may be seen in FIGS. 9 - 11. The support 35 has a pair of horizontal, L-shaped arms 155 that are connected at one end to a vertical post 156 having pivotable connections 157 with the framework 27 at one side thereof. The other ends of the arms 155 are interconnected by a vertical post 158 having end plates 159 and 160. Adjacent the post 158, the arms 155 are also interconnected by a supporting member 161, having a plate 162 pivotally connected thereto as at 163. An electric motor 164 secured to the plate 162 has a double pulley 165 fixed on its vertical, upwardly disposed drive shaft 166. In practice, the motor 164 remains in operation whenever the apparatus is in use.

A vertically disposed U-shaped dust hood 167 has a rib 168 by which it is secured to the post 158 between the end plates thereof. One side wall of the hood 167 has a port 169 opening into a laterally disposed dust conductor 170 connected to a suitable suction source, not shown.

The end plates 159 and 160 have mounts 171 and 172, respectively, secured thereto. The mounts 171 and 172 have holders 173 and 174, respectively, connected to their outer ends by vertically aligned pivots 175. Rearwardly of the pivots 175, the holders 173 and 174 have the end plates 176 of a post 177 secured thereto with the post 177 inside the dust hood 167.

A mount 178 is secured to the upper end of the post 177 and is provided with bearings 179 of substantial axial extent rotatably supporting the vertically disposed spindles 180 of the tools 32 and 33. Each of the spindles 180 has a pulley 181 fixed on its upper end, a nut 182 threaded on its lower end, and an annular shoulder 183 adjacent its bearing 179. It will be noted that the axis defined by the pivots 175 is between the axis of the spindles 180 and in the plane common therewith. One idler pulley 184 in back of the pulley 181 is pivotally connected to the undersurface of the holder 173, see FIG. 10. The lower each of each spindle 180 is spaced a short distance above a bearing block 185 connected to a mount 186 fixed on the lower end of the post 177. The connection between the block 185 and the mount 186 includes a transverse spline 186A and a screw 186B extending at right angles thereto through the block 185 and threaded into the mount 186. With the key and bolt removed, the block 185 is released to be dropped downwardly and removed to expose the lower end of each spindle 180.

The tools 32 and 33 are each shown as including a sleeve fitted on its spindle 180, once the nut 182 has been removed therefrom, the seated and anchored against its shoulder 183 by the nut 182 when replaced thus to be so locked to the spindle 180 as to rotate therewith. The sleeves are abrasive coated, the sleeve 187 for coarse grinding and the sleeve 188 for fine grinding or finishing the work. Each tool must also include means engageable with the periphery of the template 46 when the unwanted material has been removed from the work and, accordingly, each of the tools is provided with a coaxial roller 189 having a shaft 189A rotatably supported by the bearing block 185.

Figure 12:
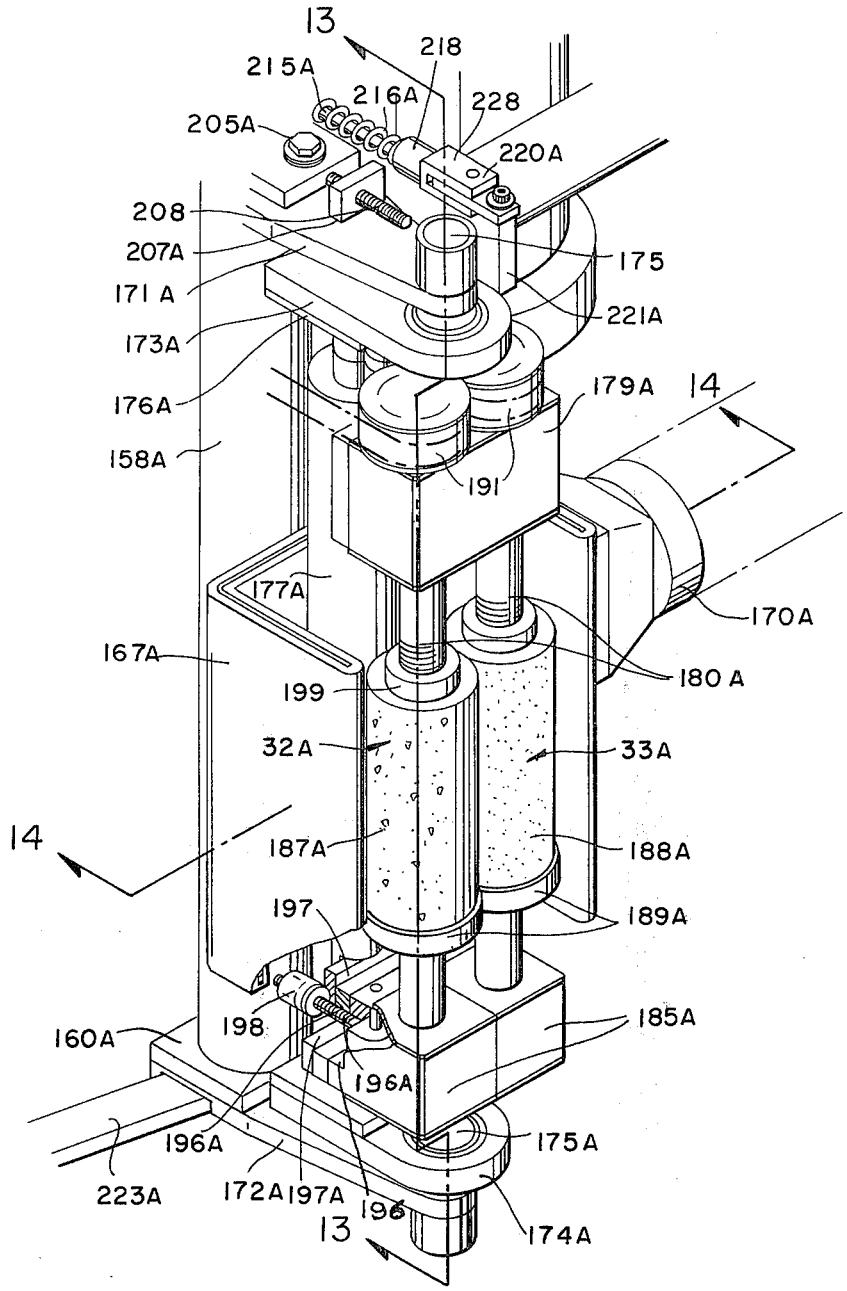
FIG. 12 is a perspective view showing a tool assembly in accordance with another embodiment of the invention.
Figure 13:
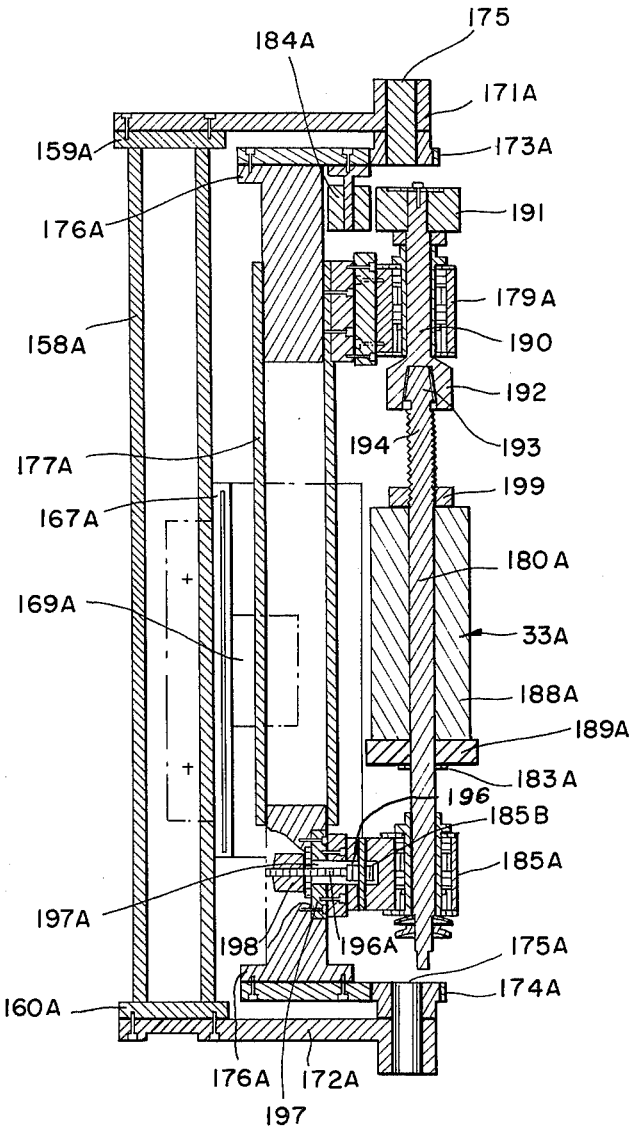
FIG. 13 is a section taken approximately along the indicated line 13—13 of FIG. 12.
Figure 14:
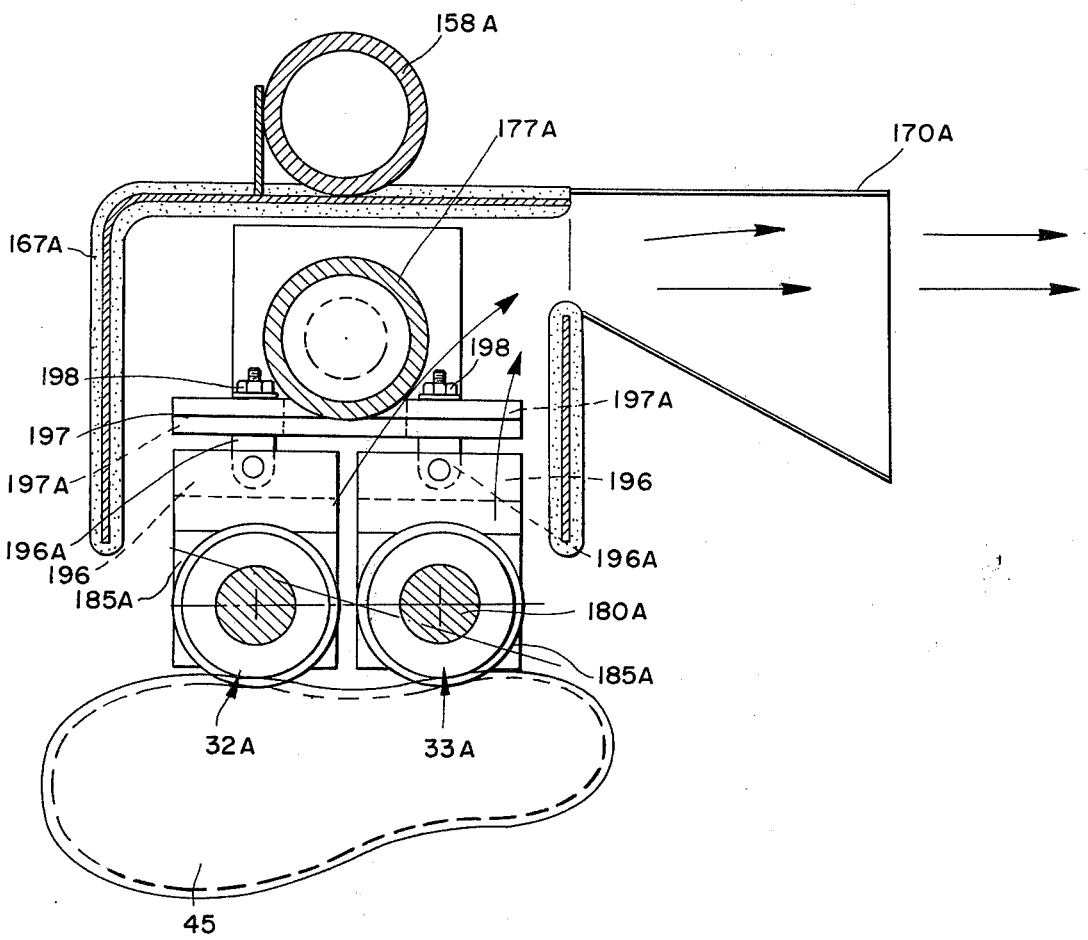
FIG. 14 is a section taken approximately along the indicated line 14—14 of FIG. 12.

Another type of tool spindle is shown in FIGS. 12 – 14 with corresponding parts distinguished by the suffix addition A to the appropriate reference numerals. In this embodiment, the spindles are replaced by relatively short shafts 190 each having a pulley 191 fast on its upper end and an internally splined, tapered socket 192 at its lower end. Each spindle 180A has a tapered, splined head 193 above its threaded portion 195, dimensioned to fit within and provide a driving connection with a socket 193. Adjacent its lower end, each of the spindles 180A has an annular shoulder 183A and its lower end is secured in a bearing block 185A having a transverse slot 196 for a rearwardly extending bolt 196A pivotally connected to each block 185A to swing laterally thereof. A mount 197 attached to the lower end of the post 177A has a slot 197A opening through each of its ends, each slot exposed at the appropriate side of the post 177A to enable the appropriate bolt 196 to be swung into or out of it and, when seated therein, secured in place as by a nut 198. With this construction, each of the bearing blocks 185A with its spindle may be quickly and easily detached from the post 187A and lowered to enable the splined head 203 of the associated spindle to be withdrawn from the socket 192 of the appropriate one of the shafts 190. The heads 193 of the spindles 180A are dimensioned so that a template engaging member 189A and an abrasive coated sleeve may then be fitted on each of the spindles with the member 189A resting on the annular shoulder 183A and the abrasive ocated sleeve engaged by a clamping nut 199 when threaded on the spindle portion 194.

The motor supporting plate 162 has one end of a turnbuckle 200 connected thereto and its other end threaded through a cylindrical nut 201 rotatable in a holder 202 attached to a block 203. The block 203 is secured to a plate 204 provided with aligned, lengthwise slots 205 through which screws 206 freely extend and which are threaded into the upper mount 171 of the post 158, on which mount there is a fixed nut 207 through which an adjusting screw 208 extends and by which the block 203 is held in a desired position. A vertical shaft 209 is rotatably supported by a block 203 and has a pulley 210 fast on its lower end and a double pulley 211 fast on its upper end and connected to the motor pulley 165 by belts 212 that may be tightened by means of the turnbuckle 200. The pulley 210 is connected to the pulleys 181 by a belt 213, which is also trained about the idler 184. The belt 213 may be tightened by turning the screw 208 in the appropriate direction.

While the tool unit 30 is free to pivot as required as the clamped work turns against the tools and as the template 46 is moved by its drive, it is provided with means yieldably holding it in a normal position and including a block 214 attached to one side of the holder 171 of the post 158. A rod 215 extends through and is slidably supported by the block 214 which serves to back the springs 216 and 217, the spring 216 seated against a stop 218 adjacent the forward end of the rod 215 and the spring 217 seated against a stop 219 adjacent the rearward end thereof. A link 220 is pivotally connected to the forward end of the stop 218 and to the holder 173A by an anchor 221. The stop 219 bears against a back stop 222 attached to the rear framework 27.

As stated earlier, the support 35 is moved into and out of a position in which the constantly rotating tools engage the work by means of the piston-cylinder unit 36. As shown in FIG. 9, an arm 223 secured to the undersurface of the mount 172 is pivotally connected to the stem 36B of the unit 36. A bracket 224 supported by side framework 27 supports stops 225 which limit the travel of the arm 223 and accordingly the operative and inoperative positions of the tools, the former in front of and the latter rearwardly of the path of the door 31 which shields the tools while work is being placed in clamping position and while it is being removed therefrom. The stops 225 are connected to the bracket 224 for adjustment towards or away from each other as maybe required to ensure the effective engagement of the tools 32 and 33 with the work of different sizes.

The Work Locator

The work locator 48, see FIGS. 1, 2, and 15 – 17, includes an adjustable work support generally indicated at 226 and is connected to a holder, generally indicated at 227. The holder 227 includes a supporting rod 228 locked in a sleeve 229 fixed on the upper end of an arm 230 whose lower end has a sleeve 231 receiving a pivot 232 attached to a slide 233 in a channel 234 secured to the cabinet below the shelf 26. The other end of the pivot 232 is held by a brace 235 pivotally secured to the side of the cabinet. The locater 48 is thus movable from its work-receiving position remote from the work holder 28 in which the arm 230 rests against a stop 236 secured to the framework adjacent the outer edge of the shelf 26 into a position in which the work is accurately held in a position over the template 46 to be clamped thereagainst by the upper clamping member 47. When the locator 48 is moved to seat against the stop 236 the valves 51 and 51A are actuated to cause the apparatus to operate through a complete cycle if the valve 49 is held open.

Figure 15:
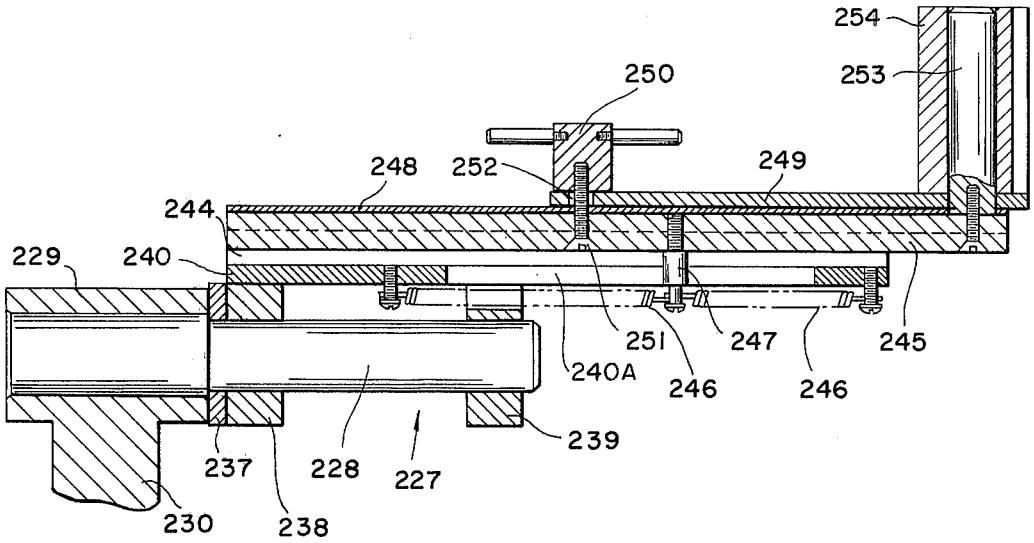
FIG. 15 is a section taken approximately along the indicated line 15—15 of FIG. 1.
Figure 16:
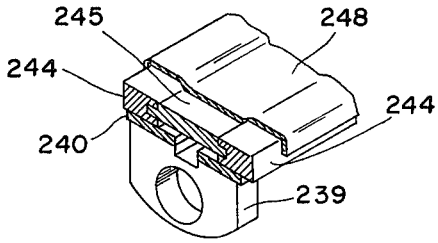
FIG. 16 is a section taken approximately along the indicated line 16—16 of FIG. 1.

In more detail and as may be seen in FIGS. 15 and 16, the rod 228 extends through a mounting plate 237 which is secured to the inner end of the sleeve 229 and through axially spaced supports 238 and 239 to which a floor plate 240 is attached. The support 238 extends in back of a slot 241 in the mounting plate 237, see FIGS. 1 and 2, and has a screw 242 extending therethrough with a lock nut 243 threaded thereon thus enabling the floor plate 240 to be connected to the sleeve 229 in a manner permitting it to be tilted relative thereto to a limited extent and locked in a selected position.

The floor plate 240 has keepers 244, see FIGS. 15 and 16, secured thereto and they define a slideway for a slide 245 held in a neutral position by a pair of opposing tension springs 246 each secured at their remote ends to the floor plate and at their proximate ends to an anchor 247 slidable in the floor plate slot 240A and attached to the undersurface of the slide 245. A cover 248, overlying the keepers 244 is held against the slide 245 by an arm 249 with a lock 250 threaded on a bolt 251 extending upwardly through the slide 245, the cover 248 and through a transverse slot 252 in the arm 249.

The slide 245 has a cylindrical post 253 extending upwardly through the cover and the arm 249 has a mount 254 that is a fit on the post 253 and is free to turn within the limits established by the slot 252 and to be locked in a selected position.

Figure 17:
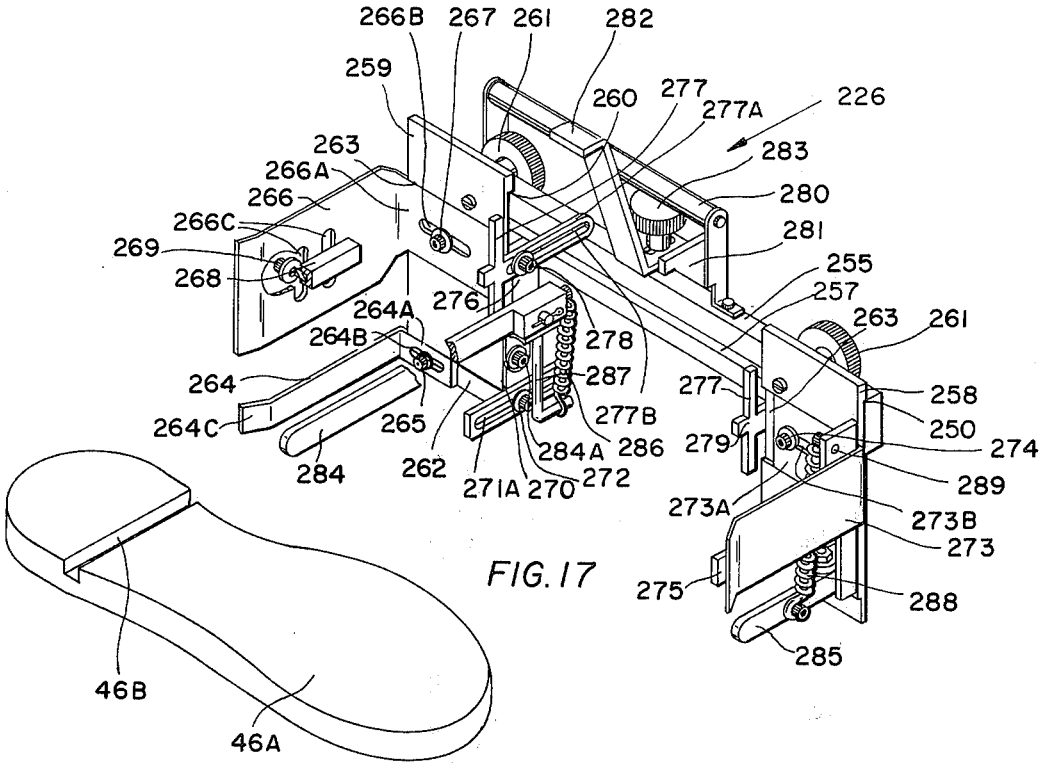
FIG. 17 is a perspective view of the work holder taken approximately along the indicated line 17—17 of FIG. 1 but spaced from the work holder.
Figure 18:
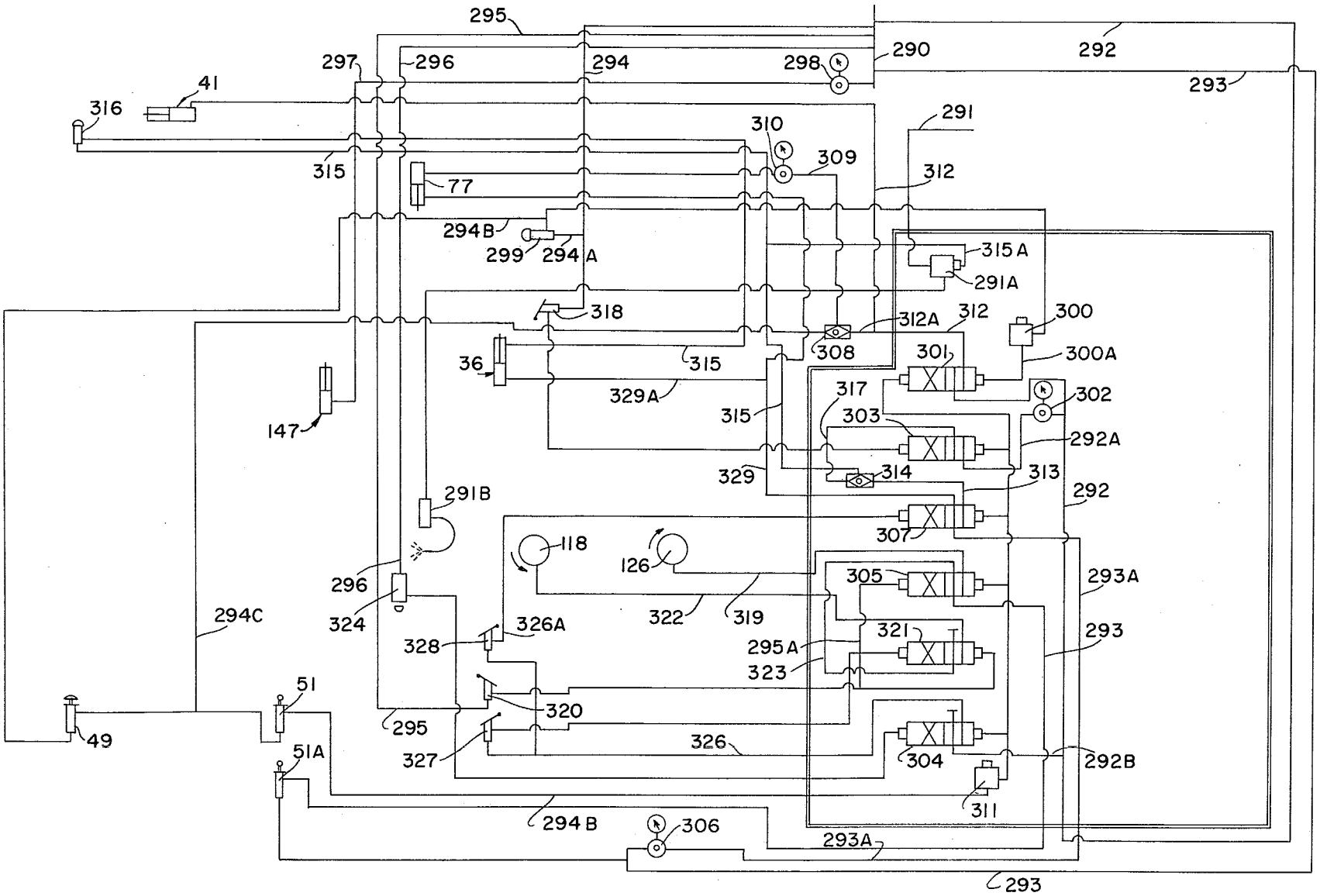
FIG. 18 is a schematic view of the operating means by which a work processing cycle is effected.

The work support 226, see FIGS. 1 and 17 includes a bar 255 to one end of which is secured an end plate 250 detachably connected to the mount 254. The bar 255 has a lengthwise slot 257 and mounts 258 and 259 have transverse shoulders 260 that slidably engage the upper surface of the bar 255. Clamps 261, exposed on the front bar 255 extend through its slot 257 and each is threaded into the appropriate one of the mounts 258, 259 enabling each of them to be slid lengthwise of the bar and to be locked in a selected position.

The mount 259 has a seat 262 extending along its inner bottom edge and it and the mount 258 have a central transverse channel 263.

An arm 264 has a base 264A disposed at right angles thereto which is held against the seat 262 by a clamping screw 265 threaded into the mount 259 through a lengthwise slot 264B thus enabling the arm 264 to be adjusted and locked in a position to engage with the proximate end of the template 46 when the locator 48 is in its operative position relative to the work holder 28. The arm 264 has its free end curved as at 264C to function as a cam as it engages that end of the template 46 thus to pull the slide 245 lengthwise of the floor plate 240 until the arm 264 is butted against the engaged end of the template, the appropriate one of the springs 246 ensuring that abutting relationship.

The base 266A of a work supporting arm 266 is held in the channel 263 of the mount 259 by a clamping screw 267 threaded into the mount 258 through a slot 266B enabling the arm 266 to be adjusted lengthwise of the mount 259 and locked in a position in which it engages one end of the work, the heel end, in the case of a work holder set up as shown in the drawings. The arm 266 has vertical slots 266C and a support 268 on which that end of the work rests is connected thereto by clamping screws 269 extending through the slots 266C enabling the support to be adjusted vertically and locked in a selected position.

At least one of the proximate ends of the mounts 258, 259 has a transverse seat 270 in the plane of the seat 262 and an arm 271 has a lengthwise slot 271A through which extends a clamping screw 272 enabling the arm 271 to be adjusted into and locked in a supporting position if it is needed.

The base 273A of a work supporting arm 273 is disposed at right angles thereto and is held in the channel 263 of the mount 258 by a clamping screw 274 threaded into the mount 258 through a lengthwise slot 273B thus enabling the arm 273 to be adjusted and locked in a position in which it is engaged by the other or toe end of the work 45, which rests on a support 275 attached to the arm 273.

The proximate ends of the mounts 258 and 259 have seats 276 above the bar 255. A vertical spacer 277 is provided for each mount and each spacer has an arm 277A held in the appropriate seat 276 by a clamping screw 278 which extends through a lengthwise slot 277B so that each spacer may be set to be engaged by a side of the work. Each spacer 277 has a support 279 intermediate its ends on which the margin of the work rests when in engagement with the spacers.

From the foregoing, it will be apparent that the work holder 236 of the locator 48 may be adjusted so that the ends of the work to be processed fit between the arms 266 and 275 with its ends held by the supports 268 and 275 and with one side seated against the spacers 277 and held by their supports 279 so that when the locator is advanced to position the work on the template 46 it is properly located with its short or transverse axis in vertical alignment with that of the template once the arm 264 is butted against the appropriate end of the template.

The bar 255 is provided with a hand grip 280 and a centrally disposed block 281 having a channel 281A at right angles to the bar 255 and in which one end of a stop 282 is secured by a clamping screw 283 extending through a lengthwise slot 282A thus enabling the position of the stop to be adjusted to engage the mount 78A of the work holder when the long axis of the work coincides with that of the template 46.

It will be appreciated that the work supports 268, 275, and 279 do not overlie the template 46 so that once the work is clamped against it by the clamping member 47, the work holder 48 may be withdrawn into its work-receiving position.

In the operation of the work locator as just described, the work 45 is assumed to be sufficiently stiff that it may be supported in the manner just described. The work holder 226 is shown, however, as having additional arms 284 and 285 so that it may be used with other work, work for example that is too flexible to be held without more substantial support, and also where for example, two work pieces are to be processed at the same time in FIG. 19.

The arm 284 is of substantial length and is pivotally mounted at 284A on the inner end of the mount 259 in a position to underlie an intermediate portion of the work to prevent its sagging and is yieldably maintained in its work supporting position by means of a spring 286 anchored by a depending arm 287 attached to the mount 259. As the arm 284 will extend across the template when the work is properly positioned relative thereto, a template 46A is used that has a transverse channel 46B dimensioned to freely receive the arm 284 and as the arm 284 is pivotally supported, it is readily withdrawn when the locator 48 is withdrawn from the template after the work has been clamped in place.

The arm 285 is pivotally connected to the mount 258 as at 285a and is spaced below the support 275 and is yieldably held in a supporting position by a spring 288 anchored as at 289. As above stated, the arm 285 is used when two pieces of work are to be simultaneously processed, with one such example illustrated by FIG. 19.

The Control System

The means by which the work is clamped to the work holder 28, the work holder rotated first in one direction and then the other, the door reciprocated between its open and closed positions, and the tool support moved between positions, one behind the door 31 and the other with the tool or tools in contact with the periphery of the work have been detailed but the operation of the apparatus has been thus far only generally described.

Figure 19:
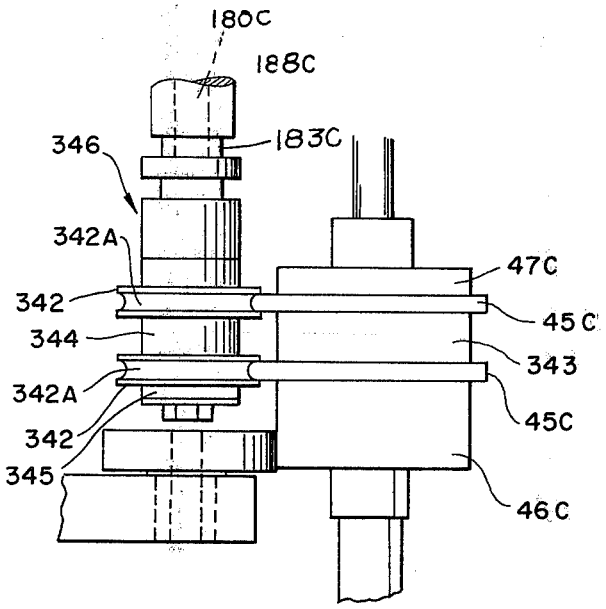
FIG. 19 is a fragmentary view of a work holder supporting two pieces of work and a tool for use in simultaneously processing both pieces.

It is preferred that the various fluid pressure operated units be pneumatically rather than hydraulically operated and that the operation of their control valves be effected pneumatically rather than electrically and reference is now made to FIG. 19 where the pneumatic system is schematically detailed and the description of that system will necessarily detail important functions of the apparatus as well as summarize its operation.

The pneumatic system is shown as having a conduit 290, connectable to a suitable source of air under pressure and, as is conventional, provided with means, not shown, operable to introduce sufficient oil into the system to ensure lubrication of the several valves and a conduit 291 for oil-free air. Operating conduits 292 and 293 for delivering air under pressure to the several units and control conduits 294, 295, 296, and 297 are all connected to the conduit 290.

Once the conduit 290 is connected to a suitable air source, the conduit 297, which is provided with a pressure regulator 298 delivers air to the piston-cylinder unit 147 which, until the main conduit 290 is disconnected from the air source remains operative as an "air spring" to yieldably draw and maintain the guide rollers 146, 146A against the inner surface of the driven members 68, 68A.

The conduit 294 has a branch 294A provided with a normally open valve 299 and a pulse valve 300. The branch 294A also has a branch 294B provided with the "pushbutton" valves 49 and 51 both of which have to be actuated together to effect the operation of the apparatus.

The operating conduit 292 is controlled by a valve 301 and has a branch 292A provided with a pressure regulator 302 and controlled by a valve 303 and a branch 292B controlled by a valve 304. The valves 301, 303, and 304 are of the type having two positions of use and to be set in one position or the other by air pressure.

The operating conduit 293 is controlled by the valve 51A and a valve 305 and, ahead of the valve 51A, the conduit 293 has a branch 293A provided with a pressure regulator 306 and controlled by a valve 307. The valves 305 and 307 are of the same type as the valve 301, 303, and 304.

The functions of the control conduits will be detailed with the normally closed pushbutton valves 49 and 51A actuated, the valve 49, first held open by the operator until the clamping member 47 clamps the work 45 against the template 46 and the valves 51 and 51A opened as by the return of the work locator 48 to its work receiving position by the operator. It will be seen that the branch conduit 294B includes a branch conduit 294C between the valves 49 and 51, which is connected through a shuttle valve 308 to a conduit 309 provided with a pressure regulator 310 and in communication with the cylinder of the unit 77 thereby to so operate it that the work 45 is clamped against the template 46 by the clamping member 47.

The conduit 294B has a pulse valve 311 operable to deliver a valve-shifting pulse to each of the valves 301, 303, 304, 305, and 307 to shift or set all of them from their first positions into their second positions in which the apparatus is operated through a work-processing cycle.

In the second or set position of the valve 301, the operating conduit 292 is connected to a conduit 312 in communication with the piston-cylinder unit 41 by which the door 31 is opened and held open against the opposing action of the spring 43. The conduit 312 also includes a branch 312A in communication with the shuttle valve 308 so that the work 45 is maintained clamped when the operator releases the valve 49.

The valve 307, when in its second or set position, connects the conduit 293A to a conduit 313 connected by a shuttle valve 314 to a conduit 315 provided with a normally closed valve 316, opened when the door 31 is open, and in communication with the piston-cylinder unit 36 by which the tool support is advanced to effect tool engagement with the work 45 or retracted to be behind the door 31 when it is closed. The conduit 315 has a branch 315A by which air is operable to open and hold open a valve 291A in the conduit 291, oil-free air then being delivered through a nozzle 291B disposed and directed to blow dust towards the dust hood 167.

When air is delivered to the unit 36 by means of the conduit 315, the support 35 is started from its rearmost position. At the same time, the valve 303, now also in its second or set position connects the branch 292A to a conduit 317 which is also in communication with the shuttle valve 314 thus to provide an increase in the air pressure of the air delivered to the unit 36 to provide a starting boost for the support 35.

When the support 35 starts from its rearward position, the valve 299 is closed thereby and it remains closed until the support 35 returns towards its starting position a distance such that the door 31 may be closed. As a consequence, the operation of the valve 49 or the valves 49, 51, and 51A, except when the tool support 35 is in the starting position, is of no avail.

On predetermined travel of the support 35 in a forward direction, it opens a normally closed valve 318 in the conduit 294 thus to deliver air under pressure to reset the valve 303 in its first position thus reducing the pressure of the air delivered to the unit 36 to that established by the pressure regulator 306 as that adequate to ensure proper tool engagement with the work 45 as the work holder turns.

The function of the pulse valve 300 is that of delivering a pulse through the conduit 300A to reset the valve 301 when the support 35 is returned to its starting position, the valve 299 then being open.

Reference is now made to the means controlling the work holder drive.

It has already been noted that an important objective of the invention is to enable work to be brought to the desired size and shape without rotating it twice. The work 45 is, accordingly, first moved a short predetermined distance in one direction as the tools 32 and 33 are brought into contact therewith and then is rotated in the opposite direction enough more than 360° so that the net travel of the work holder 28 is approximately 360° and is then stopped in a predetermined starting position.

To this end, the valve 305, in its second or set position, connects the conduit 293 to a conduit 319 delivering air to the air operated clutch 126 which then effects the reverse rotation of the work holder 28.

The conduit 295 is controlled by a normally closed valve 320 which is opened when the work holder 28 moves a predetermined short distance in a reverse direction then to deliver air to set a valve 321 in its set or second position. The conduit 295 has a branch 295A connected to the valve 305 to reset it in its first position when the valve 320 is opened thus to connect the conduit 319 to relief thereby disengaging the clutch 126. The valve 321 is of the same type as the valves 301, 303, 304, 305, and 307 and in its second or set position, a conduit 322 in communication with the clutch 118 is placed in communication with the conduit 293 through the valve 305 by means of a conduit 323. The work holder 28 is now driven in a forward direction until the valve 321 is reset, the conduit 323 then being open to relief.

As the work holder 28 must now be turned more than 360°, the conduit 296 is provided with a normally closed valve 324 adapted to be momentarily opened by an actuator 325, see FIG. 7, fixed on the driven member 68 to deliver a pulse to reset the valve 304 in its first position. Because of the extent to which the work holder 28 is turned, the actuator 325 is so positioned that the work holder 28 must rotate forwardly through a substantial arc, in practice about 180°, before it engages and operates the valve 324.

With the valve 304 now in its first position, a conduit 326, open to relief in its second or set position is now connected to the branch 292B. The conduit 326 is provided with a normally closed valve 327 and has a branch 326A provided with a normally closed valve 328. The valves 327 and 328 are operable only on forward rotation of the work holder 28 and are located to be momentarily operated to halt the work holder 28 in its predetermined starting position but that are ineffective so to do until the valve 324 has been opened.

When the valve 327 is then operated, a pulse is delivered to reset the valve 321 into its first position in which the conduit 322 is open to relief and the clutch 118 is now disengaged and the work holder stops. When the valve 328 is operated, a pulse is delivered through the conduit 326A to reset the valve 307 in its first position in which a conduit 329 is placed in communication with the operating conduit 293A to operate the clamp-controlling piston-cylinder unit 77 to release the processed work 45 when the clamping pressure in the unit 77 is released and having a branch 329A to operate the piston-cylinder unit 36 to cause the return of the tools and their support 35 to their inoperative position within the cabinet, and as previously described, the valve 299 delivers air to the pulse valve 309 with the resulting pulse returning the valve 301 to its first position with the conduits 312 and 312A both open to relief to permit the work 45 to be released and the door 31 closed by the spring 43. The fluid pressure delivered through the conduit 326 is operative to reset the valve 307 then to open the conduit 329 to relief thus to cause the release of the clamped work so that it may be removed by the operator.

Reference is now made to FIGS. 1, 2, and 7 wherein there is shown a guide 330 fixed on front framework under the shelf 26 and confining the lower ede of a slide 331 mounted on a rod 332 having end blocks 333 attached to front framework 27 below the shelf. A connecting rod 334 has a pivotal connection 335 with the slide 331 and a like connection 336 with an arm 337 fixed on the support 52 of the work holder 28. Valve actuators 338, 339, and 340 are mounted in vertically spaced slots 341 with which the slide 331 is provided and each is adjustable lengthwise of the appropriate one of the slots in order to effect valve operation in the desired manner. The actuator 338 is positioned to operate the valve 320 after predetermined short reverse travel of the work holder 28, the actuator 339 is positioned to actuate the valve 327 thereby to stop the work holder 28 in its predetermined starting position, and the actuator 240 is positioned then to actuate the valve 328 to effect the return of various control valves to their first position.

Simultaneous Processing of Plural Work Pieces

While the apparatus has thus far been described for use in processing a single piece of work 45, a number of like pieces may be simultaneously processed with one example illustrated by FIG. 19.

In FIG. 19 only one tool, the tool 320, is shown and it is of the type illustrated by FIGS. 10 and 11. In place of abrasive coated sleeves, a pair of cutters 342 are employed, each shown as having a concave cutting surface 342A thus to round the edges of the work pieces 45C.

The work pieces 45C are separated by a spacer 343 and the assembly is clamped to the template 46C by the clamping member 47C. The cutters 342 are positioned relative to the spindle 180C to engage properly the work pieces 45 when supported by the work holder and to that end the two cutters 342 are separated by a spacer sleeve 344 with the lower cutter 342 spaced from the end of the spindle 180C by a spacer sleeve 345 and an axially extendable spacer sleeve 346 is positioned between the upper cutter 342 and a shoulder 183C. Where two tools are employed, the other tool is of the same construction except for its cutter.

The Limited Processing of the Work

The processing of the work has thus far been described as having the entire periphery thereof subject to the attack of the tools but the apparatus is equally well adapted for use where different processing is required.

A requirement may be that some portion of the periphery of the work be not processed even where two tools are used or it may be a requirement that the entire periphery be processed by one tool and less than the entire periphery be processed by the other tool.

Figure 20:
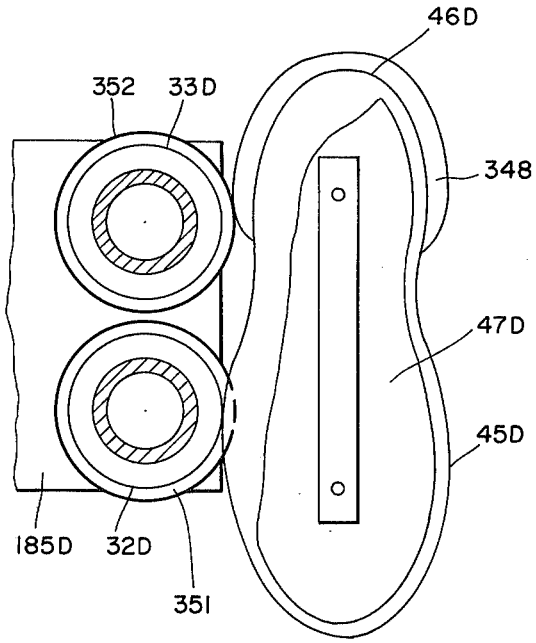
FIG. 20 is a fragmentary plan view of tool and template combination for use where a tool is to be prevented from attacking a portion of the rotating work.
Figure 21:
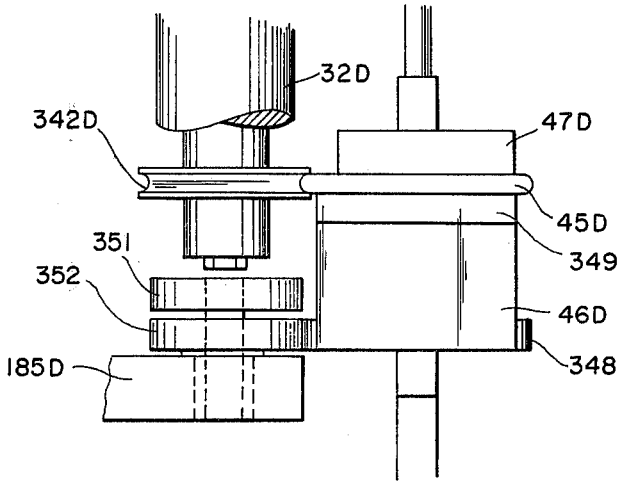
FIG. 21 is a view of the structure shown in FIG. 20 with the template shown as viewed from an end thereof.
Figure 22:
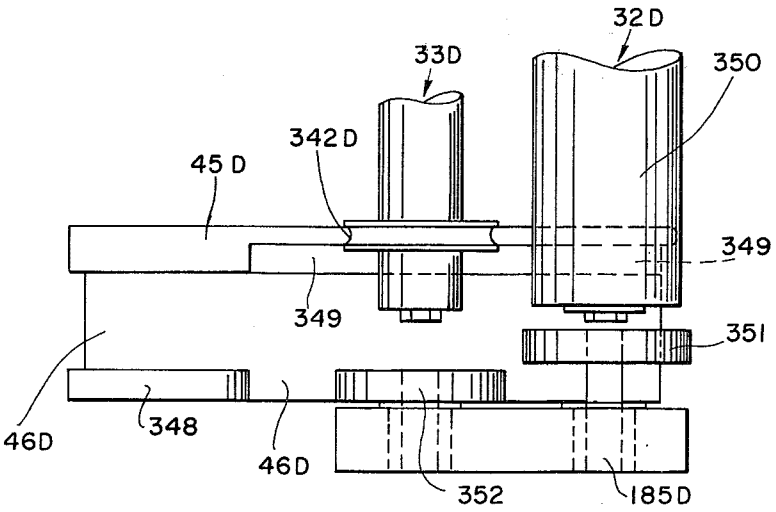
FIG. 22 is a view showing both tools and the template as viewed from the side thereof engaged by the tools.

By way of example, see FIGS. 20 – 22, a work piece 45D may be a sole with an integral heel and the requirement may be that the heel area of the work be brought to size but that the portion of the sole forwardly thereof be rounded. To that end, a template 46D is provided that establishes the desired size and shape of the work and has a cam portion 348 that corresponds to the shape of the heel portion of the work but is spaced below it and projects outwardly therefrom. The template 46D is shown as having an insert 349 dimensioned to underlie and support the work forwardly of its heel portion.

The tools 32D and 33d are of the same type as the tools shown in FIGS. 10 and 11 and are supported in the same manner in their tool holder, not shown. The tool 32D has its material-removing portion 350 of any type but is of sufficient axial extent to remove unwanted material from the entire periphery of the work 45D and its template-engaging roller 351 is supported by the bearing block 185D at a height such that it engages the periphery of the template 46D above the cam portion 348. The tool 33D has its material-removing portion adapted to provide a predetermined finished margin forwardly of the sole portion, a cutter 342D, for example, and its template-engaging roller 352 is at a height relative to the bearing block 185D so that it will engage the cam portion 348 as the work is completely turned. As the tools 32D and 33D are pivotally supported, the tool 33D is now forced away from the work and thus prevented from attacking the heel portion thereof.

From the foregoing, it will be apparent that apparatus in accordance with the invention is well adapted to meet a wide range of processing requirements including the removal of material from the periphery of work pieces regardless of their shapes.

We claim:

1. Apparatus for removing material from the periphery of work to impart thereto a predetermined, non-circular size and shape, said apparatus comprising a rotatable work holder including a non-circular template of at least the wanted shape, means operable to remove material from the periphery of the work including at least one tool portion operable to remove material from the periphery of the work and a second portion engageable by the periphery of the template when the unwanted material is removed from the work, a drive operable to so rotate said work holder that the periphery of the non-circular work advances into contact with the tool at a controlled rate, said work holder drive including driving means and a driven member rotatable with the work holder and including a non-circular wall portion that is of a shape to effect said rate and with which the driving means is continuously engaged, said driving means in engagement with said wall portion and means operable to permit relative movement between said work holder and the tool as the work holder turns, the driven member advancing relative to the tool at a constant rate and the rate at which the template advances relative to the tool depending on any difference between its shape and that of said wall portion.

2. The apparatus of claim 1 in which the shape of the wall portion is sufficiently close to that of the template to make said controlled rate a substantially constant one.

3. The apparatus of claim 1 in which the wall portion of the driven member is approximately ovate with the length of its long and short axes substantially proportional to the length and maximum width of the work.

4. The apparatus of claim 3 in which the wall portion is of a configuration of at least a part of the tread portion of footwear.

5. The apparatus of claim 1 in which the work holder is movable relative to the tool and the means operable to permit such relative movement includes a support member and a linking member pivotally connected at one end to the apparatus and at its other end to the support member and the support member includes at least one arm to the free end of which the template is rotatably connected.

6. The apparatus of claim 5 and a control for the work holder drive operated by the operator to initiate work holder rotation and control means for the work holder drive operable to stop the work holder in a predetermined position, and means to operate said control means including a slidable actuator and a connecting rod pivotally connected to said slide and said support member and operable to so reciprocate said slidable actuator as to effect operation of said control means.

7. The apparatus of claim 6 in which the work holder drive is reversible and the control means include a forward control and a rearward control with one of said two controls effecting a predetermined short movement thereof in one direction and the other effecting the turning of the work holder in the opposite direction through 360° and a further distance equal to said short movement thereby to provide identical starting and stopping positions.

8. The apparatus of claim 7 in which said predetermined starting position is such that the first and last motions imparted to the driven member are substantially linear.

9. The apparatus of claim 6 in which the drive includes a clutch and a speed reducer, the clutch is disengaged to stop work holder rotation and the gear ratio of the speed reducer prevents any material turning of the work holder once the clutch is disengaged.

10. The apparatus of claim 5 in which the support member for the work holder includes an upper arm and an upright interconnecting corresponding ends of said arms, the upper arm overlying the first named arm, a clamping member includes a spindle slidably and rotatably supported by the upper arm with its axis in vertical alignment with the axis of rotation of the template, and clamping means carried by the upper arm and connected to the spindle and operable to reciprocate the clamping member relative to the template between a position clamping work there against and a position releasing clamped work.

11. The apparatus of claim 10 and means connecting the spindle to the work holder drive through the upright to effect the positive turning of the clamping member with the template.

12. The apparatus of claim 10 in which there is a shelf having an opening through which the upright extends and which is dimensioned to accommodate the travel of the work holder and the upright as the work is turned against the tool, and the work holder has shielding means including a first member carried by the upright to move therewith and covering the front part of the opening and a second member slidably attached to the undersurface of the shelf and movable with the first arm.

13. The apparatus of claim 1 in which the driving means includes a support, a pair of closely spaced rotatable members mounted on said support in engagement with said driven member, a slide includes a rotatable guide member having its axis parallel to the axes of said pair of members, said slide connected to said support with the guide member positioned for engagement with the inner surface of the wall portion of the driven member and for movement towards and away from said pair of members with its axis between their axes, and resilient means secured to said support and connected to said slide yieldably urging the guide member towards said pair of member.

14. The apparatus of claim 10 in which the yieldable means is an air operated, piston-cylinder unit.

15. The apparatus of claim 13 in which said wall portion includes an external and continuous series of gear teeth and each of said pair of members is a gear in mesh therewith.

16. The apparatus of claim 15 in which the series of teeth with which the wall portion of the driven member is provided is of a vertical extent less than the height of said wall portion, and each gear includes a bearing portion engageable with the wall portion adjacent its teeth and dimensioned to prevent the bottoming of the meshing teeth.

17. The apparatus of claim 1 in which the driving means includes a support, a pair of closely spaced, rotatable members mounted on said support close to the driven member, one member connected to the drive and the other an idler, a slide includes a rotatable guide member having its axis parallel to the axes of said pair of members, said slide connected to said support with the guide member positioned for engagement with the inner surface of the wall portion of the driven member and for movement towards and away from said pair of members with its axis between their axes, resilient means secured to said support and connected to said slide yieldably urging the guide member towards said pair of members, an additional idler member, means connecting said idler to said support for movement towards and away therefrom, resilient means urging said additional idler away from said support, and an endless member in trained engagement with said rotatable members.

18. The apparatus of claim 17 in which the endless member is a belt, the members with which it is in trained engagement are pulleys and the pair of members are so spaced relative to the driven members to provide a substantially maximum length of the endless member in engagement with the driven member as the work holder turns.

19. The apparatus of claim 18 in which one surface of the endless member is in engagement with the driving member and the additional idler member and the other surface thereof is in engagement with each of the pair of members, and the additional idler member is so positioned that a greater portion of the periphery of the driving member is engaged by the endless member than is the case with the other of said pair of members.

20. The apparatus of claim 19 in which each of said pair of rotatable members includes a bearing portion below the belt engaging portion engageable with said wall portion.

21. The apparatus of claim 19 in which the driving member has the surface that is in engagement with the drive pulley provided with a continuous series of teeth, and the pair of pulleys have teeth in mesh therewith.

22. Apparatus for removing material from the periphery of work to impart thereto a predetermined size and shape, said apparatus comprising a rotatable work holder including a template of at least the wanted shape, means operable to remove material from the periphery of the work including at least one first portion operable to remove material from the work and a second portion engageable with the template when the unwanted material has been removed, a reversible drive to rotate said work holder with the tool in engagement with the periphery of the work, first and second means in control of said work holder drive to control the direction and extent of work holder rotation, one of said control means operable to initiate work holder movement, one of said control means operable to effect predetermined short movement of the work holder in a reverse direction and the other to effect the movement of the work holder in a forward direction, and third control means operable to halt the work holder in a predetermined starting position after it has turned enough more than 360° to bring said work holder into said position for a second time.

23. The apparatus of claim 22 in which the control means that effects said movement in the reverse direction is first operated.

24. The apparatus of claim 23 and means operable to move the tool into engagement with the periphery of the work when the work holder is operated in said reverse direction and to move the tool away from the work holder when the work holder stops in said predetermined starting position.

25. The apparatus of claim 22 in which the reversible drive includes first and second clutch controlled means, the first to effect work holder rotation in a forward direction and the second to effect reverse movement thereof, and a speed reducing unit.

26. The apparatus of claim 25 in which the reversible drive also includes a drive shaft, a parallel driven shaft connected to the speed reducing unit, and each clutch controlled means includes drive and driven members and an endless member in trained engagement therewith, the second clutch controlled means also includes a holder between which and the drive shaft the driven shaft is located and which is adjustable towards or away therefrom and which includes a pair of idler members so spaced and positioned that the endless member of said second means when trained about them and the drive member has a loop that is trained about the driven member thereof.

27. The apparatus of claim 25 in which the second clutch controlled member provides a higher driven shaft speed than the first clutch controlled means.

28. Apparatus for removing material from the periphery of work to impart thereto a predetermined size and shape, said apparatus comprising a rotatable holder including a template of at least an approximation of the wanted shape and means to clamp the work thereto, a drive to rotate said holder including an electric motor, first control means operable to effect the rotation of said work holder, at least one tool, said tool having a first portion operable to remove material from the article and a second portion engageable with the periphery of the template when the unwanted material is removed from the article, a support for said tool, and tool positioning means operable to reciprocate said support between an inoperative position in which the tool is remote from the work holder and an operative position in which the second tool portion may engage the periphery of the template when the unwanted material is removed from the article by the first tool portion, second control means operable to control said tool positioning means to effect the operative and inoperative tool positions, starting means operable to effect the operation of the first and second control means to effect work holder rotation with the tool in engagement with the work, and stopping means operative to effect the operation of said first and second control means to halt the turning of the work holder in a predetermined position and to return the tool to its inoperative position upon the removal of the unwanted material from the work on predetermined rotation of the work holder.

29. The apparatus of claim 28 and third control means operative first to render the work clamping means operable and then inoperable and fourth control means operated by said starting means first to render operable first the work clamping means and then said other control means at the end of the cycle to release the clamped work when the tool is remote therefrom.

30. The apparatus of claim 29 and a shield movable into and out of a position in the path of the tool as it moves into and out of its operative position, means to effect such movements of the shield and fifth control means operable by said starting means to move the shield out of said path, said second control means including a control operated by said shield when out of the tool path to render said second control means operable, and said fifth control means including a control operated in response to the repositioning of the tool rearwardly of that occupied by the shield in its operative position, thus operating said shield moving means to release the shield to its operative position.

31. The apparatus of claim 28 in which the tool is rotatable and a drive therefor carried by the support.

32. The apparatus of claim 31 in which the first and second tool portions are directly interconnected.

33. The apparatus of claim 31 in which the second tool portion is rotatably attached to the support in a position coaxial with but independently of the first tool portion.

34. The apparatus of claim 28 in which there are two rotatable tools, one a rough processing tool and the other a finishing tool.

35. The apparatus of claim 33 in which the support includes a pivotal holder having its pivot axis between and in the plane of the axis of the two tools, each tool includes a rotatable member and the drive includes an endless member in trained engagement with the rotatable members.

36. The apparatus of claim 31 in which the tool is yieldably held in engagement with the work and the template includes a cam projecting outwardly lengthwise of a portion of its periphery and engageable by the second tool portion thereby to force the first portion out of engagement with the work.

37. The apparatus of claim 35 in which the template includes a cam projecting outwardly lengthwise of a portion of the periphery and the second portion of one tool is positioned to engage therewith and thereby force the first portion thereof out of engagement with the work.

38. The apparatus of claim 31 in which the first portion of the tool includes sections and the work includes a plurality of separate, vertically spaced work pieces and a spacer between said sections.

39. Apparatus for removing material from the periphery of work, said apparatus including a rotatable work holder provided with a template, a drive for said work holder including at least one fluid pressure operated unit operable in a first position to connect said drive to said work holder and in a second position to disengage said drive therefrom, at least one tool, tool positioning means including a fluid pressure operated unit operable in a first position to move said tool into engagement with the work and in a second position to space the tool therefrom, a clamp, a fluid pressure operated unit connected to the clamp and operable in a first position to move it into clamping engagement with work supported by the work holder and in a second position in which the work is released, means to deliver fluid under pressure to said units and including a valve in control of the drive unit and a valve in control of the tool positioning unit, each valve having two positions of use, one for each position of the unit it controls, first and second control means each including a control member, the first control means when in operation, effecting the first position of the clamp operating unit and rendering the second control means operative, the second control means, when in operation effecting the position of the valve in control of the drive unit that effects the first position thereof and the position of the valve in control of the unit of the tool positioning means that effects the first position thereof, means operated by predetermined rotation of the work holder to reset the valve in control of the drive unit to effect the second position thereof thereby to stop the work holder in a predetermined position, to reset the valve in control of the tool positioning unit to effect the second position thereof thereby to cause the tool to be positioned away from the work, and to effect the second position of the clamp operating unit thereby to cause the release of the clamped work.

40. The apparatus of claim 39 and a shield movable between a first position in the path of the tool and a second position out of said path and means to effect such movements including a fluid pressure operated unit operable in a first position to move and hold said shield into its second position and a second position in which the shield is released and returned to its first position, said fluid pressure delivery means including a valve in control of said unit and having two positions, one for each position of the unit it controls, the second control means, when in operation, effecting the position of said valve that effects the first position of said shield-moving unit and said tool positioning means also including a control normally rendering the tool positioning unit inoperative to effect the first tool position but rendered operative by movement of said shield into its second position, and means operated by predetermined travel of said tool positioning means away from the work holder to effect the second position of said valve in control of the shield-moving unit.

41. The apparatus of claim 39 in which the shield-moving means includes a spring yieldably opposing movement of the shield into its first position and is operative to return the shield into its second position when the valve in control of the unit of the shield-moving unit is in its second position.

42. The apparatus of claim 39 and means operated in response to predetermined movement of one of the units, that is subject to control by the second control member, into its first position to render the control members of the first and second control means inoperative until all of said valves are in their second position.

43. The apparatus of claim 39 in which the work holder drive includes a second fluid pressure operated unit and the first named drive operating unit when in its first position effecting the first reverse movement of the work holder, the second unit of the drive is operable in its first position to connect said drive to the work holder to rotate it forwardly and in a second position to disengage the work holder from the drive and the fluid pressure delivery means includes an additional two position valve in control of said second drive unit, one valve position for each position of that unit, the second control means includes a first control operated by predetermined reverse movement of the work holder to effect the positions of the first named and the additional valves that establish the second position of the first drive unit and the first position of the second drive unit, and said second control means including a second control operable in response to work holder rotation to effect the position of said additional valve in which the second drive unit is in its second position when said work holder is in a predetermined position and a third control also operated in response to work holder rotation to render said second control inoperative when the work holder first reaches said position.

44. Apparatus for removing material from the periphery of work, said apparatus including a rotatable work holder provided with a template, a drive for said work holder including at least one fluid pressure operated unit operable to connect said drive to said work holder, at least one tool, tool positioning means including a fluid pressure operated unit to move said tool into and out of engagement with the work, a clamp, a fluid pressure operated unit connected to the clamp to move it into and out of clamping engagement with work supported by the work holder, means to deliver fluid under pressure to said units and including a first valve for the drive unit and a second valve for the tool positioning unit, each of said valves having two positions of use, means to deliver air under pressure to said valves including a first conduit provided with first and second normally closed control valves and connected to the valves for the drive unit and the tool positioning unit and operable to set them to connect the work holder to the drive and to position the tool in engagement with the work, and a branch between said control members in communication with the clamp operating unit and operable to deliver work clamping pressure thereto when the first control valve is operated, air under pressure then being delivered to set said two-position valves when the second control valve is operated, and means operated by said work holder on predetermined rotation thereof to deliver air under pressure to said two position valves to reset them and also to operate the unit in control of the clamp to effect the release of the clamped work.

45. The apparatus of claim 44 in which the work holder includes a non-circular member to which the drive is connected and which includes at least one substantially straight side portion and means supporting the work holder to enable the work holder to move linearly by the operation of the drive as it is turned through 360°, and said means operating the control valves of the second and third air delivery conduits are operated during said linear movement.

46. The apparatus of claim 44 in which the work holder drive includes a second fluid pressure operated unit and the valve in control of the first named drive operating unit, when set, effects reverse rotation of the work holder and the second unit of the drive when operated effects forward work holder rotation, the fluid pressure delivery means includes third and fourth valves, each having two position of use, the first air delivery conduit connected to the fourth valve to set it when the second control valve is operated, a second air delivery conduit includes a normally closed control valve and is then connected to the first and third two position valves to reset the former when the second air delivery conduit control valve is opened thus to render the first drive unit inoperable and to set the latter, means operated by predetermined, relatively minor movement of the work holder with the first drive unit in control of the work holder drive to open said air delivery conduit control valve, a conduit interconnects said first and third valves and places said fluid pressure delivery means in communication with the second unit of the drive when the first valve is reset and the third valve set thereby to effect forward movement of the work holder, and a third air delivery conduit includes a control valve and is connected to said fourth two position valve to reset it when said third air delivery conduit control valve is opened thereby to render said second work holder drive unit inoperable, means operated by said work holder when in a predetermined position with said second drive unit in control of the work holder drive to open said third air delivery conduit control valve, a conduit is placed in communication with the pressure delivery means when the fourth two position valve is reset and is then connected to said third two position valve to reset it, a normally closed valve in said third air delivery conduit, and means operated by said work holder to open said normally closed valve in said third air delivery conduit when the work holder has once been placed in said predetermined position whereby the work holder is stopped in said predetermined position after having been turned through 360° plus a distance equal to its reverse movement while the first unit of the work holder drive was in control thereof.

47. The apparatus of claim 46 in which the predetermined position of the work holder is such that the initial and final movements of the work holder are linear.

48. The apparatus of claim 44 and a conduit including a fifth valve having two positions of use, the first air delivery conduit connected to the fifth valve to set it when the second control valve is open, said conduit then effecting communication between the tool positioning unit and the fluid pressure delivery means, an additional air delivery conduit includes a normally closed valve and is connected to said fifth valve to reset it, said normally closed valve opened momentarily in response to predetermined operation of said tool positioning unit when operated to advance the tool towards the work holder thereby to provide a boost during the first part of its travel in that direction, and means operable to prevent air being delivered through either said second two position valve or said fifth two position valve from reaching the other.

49. The apparatus of claim 48 in which the fluid pressure delivery means includes first and second conduits both provided with pressure regulating means, the first conduit controlled by the second valve and the second conduit controlled by the fifth valve.

50. The apparatus of claim 44 and a shield supported by said apparatus for movement between a first position in the path of the tool and a second position out of said path, a fluid pressure operated means connected to said shield and operable to move it into its second position, a conduit including a valve having two positions of use and effecting, when set, communication between said fluid pressure delivery means and said shield operating means, said first air delivery conduit connected to said last named valve and operable to set it when the second control valve of said first air delivery conduit is open, an additional air delivery conduit includes a normally open valve and a pulse valve and connected to the valve in control of the shield moving unit to reset it, and the means to deliver fluid under pressure to the tool positioning unit includes a normally closed valve opened in response to the operation of the shield moving unit to effect the second shield position, and said normally open valve of said additional air delivery conduit closed in response to the operation of the tool positioning unit while said tool is between the work holder and the position occupied by the shield when in its first position.

51. The apparatus of claim 50 and a spring connected to said shield and yieldably urging it into its first position.

52. The apparatus of claim 44 and an additional conduit including a valve having two positions of use and effecting, when set, communication between the clamp operating unit and said pressure delivery means to effect work clamping, said first air delivery conduit connected to said valve in said additional conduit to set when the second control valve of said air delivery conduit is opened, and means operable to prevent air being delivered through either one of the two position valves to the clamp operating unit to effect the clamping of the work from reaching the other.

53. The apparatus of claim 52 and a shield supported by said apparatus for movement between a first position in the path of the tool and a second position out of said path, means to reciprocate said shield between said positions and including a fluid pressure operated unit, a branch conduit in communication with the shield moving unit and with said additional conduit for said clamp operating unit, and means to deliver fluid under pressure to the tool positioning unit includes a normally closed valve opened by the shield when in its second position.

54. The apparatus of claim 44 in which the first air delivery conduit includes a normally open valve ahead of said two control valves, and closed in response to the operation of one of said units when the two position valve in control thereof is set.

55. The apparatus of claim 54 in which said one unit is the tool positioning unit.

56. The apparatus of claim 44 in which the fluid pressure delivery means includes means operable to adjust the fluid pressure delivered to the tool positioning unit and means operable to adjust the fluid pressure delivered to the clamp moving unit.

57. Apparatus for shaping work by removing material from the periphery thereof, said apparatus including a rotatable work holder including a template of at least the wanted shape and means operable to clamp the work to the template, means to rotate the work holder with the work clamped thereto, at least one tool having a first, material-removing portion engageable with the work at lest when the work holder is turning and a second portion engageable with the periphery of the template when the unwanted material has been removed from the work by the first portion, and a work locator attached to the apparatus for movement between a work receiving and a predetermined position relative to the work template, said locator including means engageable with the work holder to establish said predetermined position and a work receiver, said receiver including a pair of end members and at least one intermediate member, each of said members projecting towards the work holder and including a first portion engageable with the periphery of the work and a second portion disposed then to underlie marginal material of the work that is to be removed and hold the work in a position to overlie the template, said end members adjustable towards and away from each other and said intermediate member adjustable towards and away from the work holder thereby to enable the members to be adjusted to receive work of a pedetermined size and shape with the end members receiving the work between them with their first portions in engagement with the periphery thereof and parts of the work resting on their second portions and said intermediate member so positioned that its first portion engages the periphery of the work with a part thereof resting on its second portion, the second portions of the members so spaced relative to each other that the received work is stable with the axis on which it should be turned coincident with the axis of rotation of the template in said predetermined position of the locator.

58. The apparatus of claim 57 in which the locator includes a support connected to the apparatus to enable the locator to be moved between its two positions, said support including a connection with said receiver that is slidable and resilient means yieldably urging said connection and said receiver in a predetermined direction, the positioning means of the receiver including a cam member engageable with a portion of the template as the locator approaches its predetermined position and to be cammed moving the receiver and the connection in the opposite direction until said cam member engages that portion of the template that is directly below that part of the work held by the second named portion of one end member, said resilient means then operative to hold said cam member against said last named template portion, said positioning means also including an adjustable stop member engageable with the work holder to prevent its movement towards said work holder when in said predetermined position.

59. The locator of claim 58 in which the resilient means includes two springs biasing the connection in both directions thereby to enable the desired positioning engagement of the cam member with the template to be effected regardless of which end member the cam member is below.

60. The apparatus of claim 57 in which the receiver includes an arm disposed to underlie and support the work in an intermediate area that is to be clamped against the template, said template has a channel disposed and dimensioned to receive and freely accommodate said arm, and the arm includes a resilient yieldable connection with the receiver biasing the arm in a position to support said work above the template but yielding into the channel when the work is clamped to the template thereby to enable it to be withdrawn as the locator is moved towards its work receiving position.

61. The apparatus of claim 60 and a second arm including a resiliently yieldable connection with the receiver, said second arm located below the second portion of one end member, and yieldably held in a position to provide support for the margin of work below the second portions of the end members.

62. The apparatus of claim 57 in which there are two intermediate members and the work receiver includes a bar and first and second mounts adjustably connected to said bar for movement lengthwise thereof, said end member and each intermediate member is adjustably connected to the appropriate one of the mounts, and the cam member is adjustably secured to one of said mounts for movement lengthwise thereof.

63. The apparatus of claim 62 in which the stop member of the positioning means is adjustably secured to one of said mounts for movement at right angles to said bar.

64. The apparatus of claim 62 in which the stop member is adjustably secured to said bar for movement at right angles thereto and is disposed to engage said clamping means.

* * * * *